US007791564B2

(12) United States Patent
Cho et al.

(10) Patent No.: US 7,791,564 B2
(45) Date of Patent: Sep. 7, 2010

(54) PLASMA DISPLAY APPARATUS

(75) Inventors: Janghwan Cho, Seoul (KR); Hyunil Park, Seongnam-si (KR); Changjoon Park, Seoul (KR); Sunghwan Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 633 days.

(21) Appl. No.: 11/846,388

(22) Filed: Aug. 28, 2007

(65) Prior Publication Data

US 2008/0055302 A1 Mar. 6, 2008

(30) Foreign Application Priority Data

Aug. 28, 2006 (KR) ..... 10-2006-0081956

(51) Int. Cl.
*G09G 3/28* (2006.01)

(52) U.S. Cl. ..... 345/67; 345/214

(58) Field of Classification Search ..... 345/214, 345/60, 63, 67; 315/169.4; 313/581
See application file for complete search history.

(56) References Cited

U.S. PATENT DOCUMENTS 6,784,858 B2 * 8/2004 Awamoto ..... 345/60
7,646,365 B2 * 1/2010 Kim et al. ..... 345/82
2004/0061695 A1 4/2004 Correa et al.
2005/0225513 A1 * 10/2005 Jung et al. ..... 345/63
2008/0018560 A1 * 1/2008 Nagorny ..... 345/60

FOREIGN PATENT DOCUMENTS

EP 1437705 A1 7/2004
EP 1667096 A1 6/2005
KR 10-2003-0076189 A 9/2003
KR 10-2003-0082731 A 10/2003
KR 10-2005-0122851 A 12/2005
KR 10-2006-0034440 A 4/2006

* cited by examiner

*Primary Examiner*—Ricardo L Osorio
(74) *Attorney, Agent, or Firm*—Birch, Stewart, Kolasch & Birch, LLP

(57) ABSTRACT

A plasma display apparatus is disclosed. The plasma display apparatus includes a plasma display panel including first, second and third electrodes, a data driver supplying a data signal to the third electrode during an address period, and a sustain driver. The sustain driver consecutively supplies a first signal of a positive polarity direction, a second signal of a negative polarity direction, a third signal of a positive polarity direction, and a fourth signal of a negative polarity direction to the first electrode, and supplies a reference voltage to the second electrode during a sustain period. A duration of a bias period of the first signal is shorter than a duration of a bias period of the third signal.

20 Claims, 14 Drawing Sheets

PLASMA DISPLAY APPARATUS

This application claims the benefit of Korean Patent Application No, 10-2006-0081956 filed on Aug. 28, 2006, which is hereby incorporated by reference.

BACKGROUND OF THE DISCLOSURE

1. Field of the Disclosure

This document relates to a display apparatus, and more particularly, to a plasma display apparatus.

2. Description of the Background Art

A plasma display apparatus generally includes a plasma display panel displaying an image, and a driver attached to the rear of the plasma display panel to drive the plasma display panel.

The plasma display panel has the structure in which barrier ribs formed between a front substrate and a rear substrate form unit discharge cell or discharge cells. Each discharge cell is filled with an inert gas containing a main discharge gas such as neon (Ne), helium (He) or a mixture of Ne and He, and a small amount of xenon (Xe). The plurality of discharge cells form one pixel. For instance, a red (R) discharge cell, a green (G) discharge cell, and a blue (B) discharge cell form one pixel.

When the plasma display panel is discharged by a high frequency voltage, the inert gas generates vacuum ultraviolet rays, which thereby cause phosphors formed between the barrier ribs to emit light, thus displaying an image. Since the plasma display panel can be manufactured to be thin and light, it has attracted attention as a next generation display device.

SUMMARY OF THE DISCLOSURE

A plasma display apparatus comprises a plasma display panel including a first electrode, a second electrode, and a third electrode, a data driver that supplies a data signal to the third electrode during an address period, and a sustain driver that consecutively supplies a first signal of a positive polarity direction, a second signal of a negative polarity direction, a third signal of a positive polarity direction, and a fourth signal of a negative polarity direction to the first electrode and supplies a reference voltage to the second electrode during a sustain period, a duration of a bias period of the first signal being shorter than a duration of a bias period of the third signal.

The reference voltage may be a ground level voltage.

The duration of the bias period of the first signal may be substantially equal to a duration of a bias period of the second signal.

A sum of the duration of the bias period of the first signal and the duration of the bias period of the third signal may be substantially equal to a sum of a duration of a bias period of the second signal and a duration of a bias period of the fourth signal.

A duration of the remaining period subtracting the bias period of the first signal from a supply period of the first signal may be substantially equal to a duration of the remaining period subtracting a bias period of the second signal from a supply period of the second signal.

A duration of a bias period of the second signal may be longer than the duration of the bias period of the first signal, and may be shorter than the duration of the bias period of the third signal.

A duration of a bias period of the second signal may be shorter than a duration of a bias period of the fourth signal.

The sustain driver may supply a first voltage output from a positive voltage source to the first electrode and at the same time, may charge the first voltage to a capacitor. The sustain driver may supply a second voltage to the first electrode through the capacitor.

A period of time during which the first voltage is charged to the capacitor may be different from a period of time during which the second voltage is supplied to the first electrode through the capacitor.

The plasma display apparatus may further comprise a reference separation controller that electrically separates or connects a first reference voltage source commonly connected to the sustain driver and the second electrode from or to a second reference voltage source connected to the data driver.

The reference separation controller may be is turned on during the bias period of the first or third signal, so that the first reference voltage source is connected to the second reference voltage source. The reference separation controller may be turned off during a period of time excluding the bias period of the first or third signal from a supply period of the first or third signal, so that the first reference voltage source is separated from the second reference voltage source.

The data driver may include a first switch and a second switch. The first switch may control the supply of a data voltage output from a data constant voltage source to the third electrode, and the second switch may control the supply of a second reference voltage output from the second reference voltage source to the third electrode.

The first switch and the second switch may be turned off during a period of time when the first to fourth signals are supplied to the first electrode, so that the data driver is in a hi-impedance state.

The third electrode may be clamped during the bias period of the first or third signal, so that a voltage level of the third electrode is maintained at the data voltage. The third electrode may be floated during a period of time excluding the bias period of the first or third signal from a supply period of the first or third signal.

A floating voltage of the third electrode during a period of time when the second or fourth signal is supplied to the first electrode may be substantially equal to a sum of the data voltage and a voltage supplied during a bias period of the second or fourth signal.

The first switch may control the supply of the data voltage to the third electrode during a first period shorter than the duration of the bias period of the first signal, or control the supply of the data voltage to the third electrode during a period of time substantially equal to the duration of the bias period of the first signal.

The second switch may control the supply of the second reference voltage to the third electrode during a second period, which follows the bias period of the first signal, and may cause the third electrode to be floated during a period of time excluding the bias period of the first signal from a supply period of the first signal.

A plasma display apparatus comprises a plasma display panel including a first electrode, a second electrode, and a third electrode, a sustain driver that supplies a first sustain signal and a second sustain signal to the first electrode, and supplies a reference voltage to the second electrode during a sustain period of one subfield, the first sustain signal having a first maintaining period during which a voltage level of the first electrode is maintained at a positive sustain voltage and a second maintaining period during which a voltage level of the first electrode is maintained at a negative sustain voltage, and the second sustain signal having a third maintaining period during which a voltage level of the first electrode is maintained at the positive sustain voltage and a fourth maintaining period during which a voltage level of the first electrode is maintained at the negative sustain voltage, and a data driver that supplies a data signal to the third electrode during an address period, wherein a duration of the second maintaining period is equal to or longer than a duration of the first maintaining period, a duration of the third maintaining period is equal to or longer than a duration of the second maintaining period, a duration of the fourth maintaining period is equal to or longer than a duration of the third maintaining period, and a duration of at least one of the first to fourth maintaining periods is different from durations of the other maintaining periods.

The plasma display apparatus may further comprise a reference separation controller that electrically separates or connects a first reference voltage source commonly connected to the sustain driver and the second electrode from or to a second reference voltage source connected to the data driver.

A sum of the durations of the first maintaining period and the third maintaining period may be substantially equal to a sum of the durations of the second maintaining period and the fourth maintaining period.

BRIEF DESCRIPTION OF THE DRAWINGS

The accompanying drawings, which are included to provide a further understanding of the invention and are incorporated on and constitute a part of this specification, illustrate embodiments of the invention and together with the description serve to explain the principles of the invention. In the drawings.

DETAILED DESCRIPTION OF EMBODIMENTS

Reference will now be made in detail embodiments of the invention examples of which are illustrated in the accompanying drawings.

Figure 1:
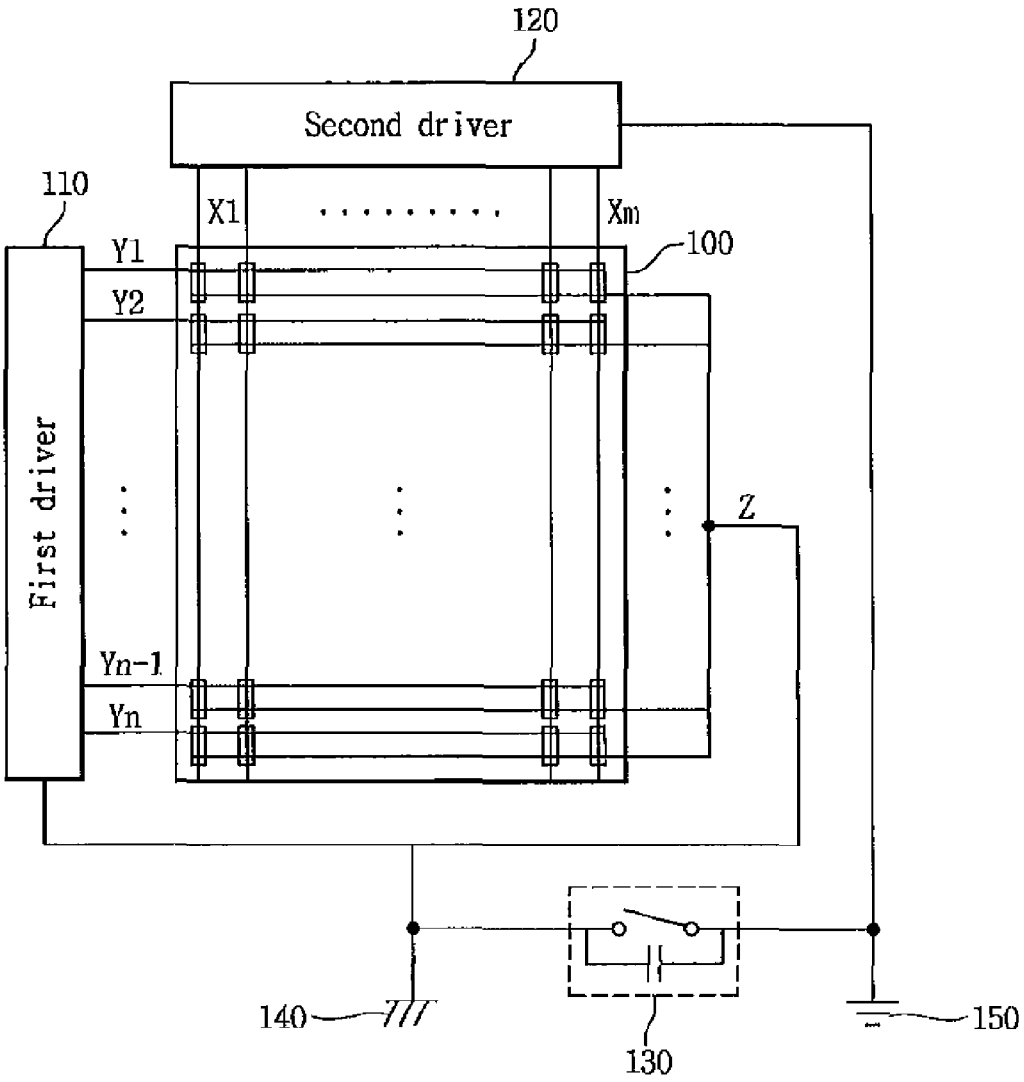
FIG. 1 illustrates a plasma display apparatus according to an exemplary embodiment.

FIG. 1 illustrates a plasma display apparatus according to an exemplary embodiment.

As illustrated in FIG. 1, a plasma display apparatus according to an exemplary embodiment includes a plasma display panel 100, a first driver 110, a second driver 120, and a reference separation controller 130.

The plasma display panel 100 includes first electrodes Y1-Yn, second electrodes Z, and third electrodes X1-Xm. One terminal of the first driver 110 is electrically connected to the first electrodes Y1-Yn, and the other terminal of the first driver 110 and a first reference voltage source 140 are electrically connected to the second electrodes Z. One terminal of the second driver 120 is electrically connected to the third electrodes X1-Xm, and a second reference voltage source 150 is electrically connected to the other terminal of the second driver 120. Hereinafter, the first electrodes Y1-Yn indicate a scan electrode, the second electrodes Z a sustain electrode, and the third electrodes X1-Xm an address electrode.

The reference separation controller 130 is positioned between the first reference voltage source 140 and the second reference voltage source 150, and electrically connects the first reference voltage source 140 to the second reference voltage source 150.

The first driver 110 may include a sustain driver, and the second 120 may include a data driver.

The first driver 110 may drive the scan electrodes Y1-Yn.

The first driver 110 may supply a reset signal to the scan electrodes Y1-Yn to initialize wall charges distributed in discharge cells. The first driver 110 may supply a sustain signal to the sustain electrodes Z to display an image. A voltage output from the first reference voltage source 140 is supplied to the sustain electrodes Z electrically connected to the first reference voltage source 140 during the supplying of the sustain signal to the scan electrodes Y1-Yn.

The sustain driver may supply a first voltage output from a positive voltage source to the scan electrodes Y1-Yn and at the same time, the first voltage may be charged to a capacitor included in the sustain driver. The first voltage is measured based on the first reference voltage source 140, and may be substantially equal to a positive sustain voltage.

The first driver 110 consecutively supplies a first signal of a positive polarity direction, a second signal of a negative polarity direction, a third signal of a positive polarity direction, and a fourth signal of a negative polarity direction to the scan electrodes Y1-Yn during a sustain period. Further, the first driver 110 supplies a reference voltage to the sustain electrode Z during the sustain period.

Although an exemplary embodiment described a case where the first signal, the second signal, the third signal and the fourth signal are consecutively supplied to the scan electrodes Y1-Yn during the sustain period, the second signal, the first signal, the fourth signal and the third signal may be consecutively supplied.

A second voltage of the capacitor of the sustain driver may be supplied to the scan electrodes Y1 to Yn. The second voltage is measured based on the first reference voltage source 140, and may be substantially equal to a negative sustain voltage.

A period of time during which the first voltage is charged to the capacitor may be different from a period of time during which the second voltage is supplied to the scan electrodes Y1 to Yn through the capacitor.

This is that the negative sustain voltage is not supplied to the scan electrodes Y1 to Yn using a separate negative constant voltage source and a power supply capacitor is charged during the supplying of the positive sustain voltage to the scan electrodes Y1-Yn. Then, when the negative sustain voltage is supplied to the scan electrodes Y1 to Yn using the power supply capacitor, a voltage drop caused by an increase in a sustain load which will be generated is prevented. The sustain load means a load effect. The load effect means that as an average picture level (APL) increases, the number of sustain signals increases.

As above, when the load effect increases due to an increase in the number of sustain signals, a voltage charged to the capacitor of the sustain driver drops due to the load effect. To prevent a voltage drop of the capacitor, a period of time during which a voltage is charged to the capacitor is set to be different from a period of time during which a voltage is supplied through the capacitor.

In an exemplary embodiment, drivers do not alternately supply the sustain signals to the scan electrode and the sustain electrodes, respectively. In an exemplary embodiment, one sustain driver supplies the sustain signal including the positive sustain voltage and the negative sustain voltage to only the scan electrode, and the reference voltage is supplied to the sustain electrode connected to the reference voltage source. Accordingly, the number of switches and electronic elements used are reduced.

Voltage sources of the first driver 110 supply voltages based on the first reference voltage source 140.

For instance, a voltage source such as a sustain voltage source supplying a voltage of a sustain signal and a setup voltage source supplying a setup signal of a reset signal supplies a voltage with a predetermined magnitude to the first driver 110 based on the first reference voltage source 140.

The first reference voltage source 140 may form a first reference voltage, and may be formed in a predetermined area using an electrically conductive material. For instance, the first reference voltage source 140 may be a frame, or may be formed in the form of a cooper foil having a predetermined area while being spatially and electrically separated from a frame. Further, the first reference voltage source 140 may be formed by attaching an electrically conductive material to a case of the plasma display apparatus. The first reference voltage source 140 can be variously formed.

The second driver 120 includes a data driver, and the data driver supplies a data signal to the third electrodes X1-Xm.

A data voltage sources of the second driver 120 supplies a data voltage of a data signal based on the second reference voltage source 150. The second reference voltage source 150 forms a second reference voltage while being spatially and electrically separated from the first reference voltage source 140. The second reference voltage source 150 may be variously formed in the same way as the first reference voltage source 140.

The reference separation controller 130 separates or connects the first reference voltage source 140 connected to the sustain driver from or to the second reference voltage source 150 connected to the data driver.

The reference separation controller 130 may include a switch, and a parasitic capacitor virtually generated by the switch.

As above, since the first reference voltage source 140 is separated from the second reference voltage source 150 by the reference separation controller 130 positioned therebetween, an opposite discharge occurs inside the discharge cell during a period of time when the sustain driver supplies the sustain signal to the first electrodes Y1-Yn.

When the reference separation controller 130 electrically separates the first reference voltage source 140 from the second reference voltage source 150, there is a voltage difference between the first reference voltage source 140 and the second reference voltage source 150. Hence, the address electrodes X1-Xm are floated depending on a change in a sustain signal. An intensity of an opposite discharge is suppressed due to a floating voltage produced by the third electrodes X1-Xm in a floating state, and a damage to a phosphor caused by the opposite discharge is prevented.

Accordingly, the discharge efficiency and a driving efficiency can increase by preventing the damage of the phosphor. Furthermore, life span of the plasma display apparatus can increase.

Figure 2:
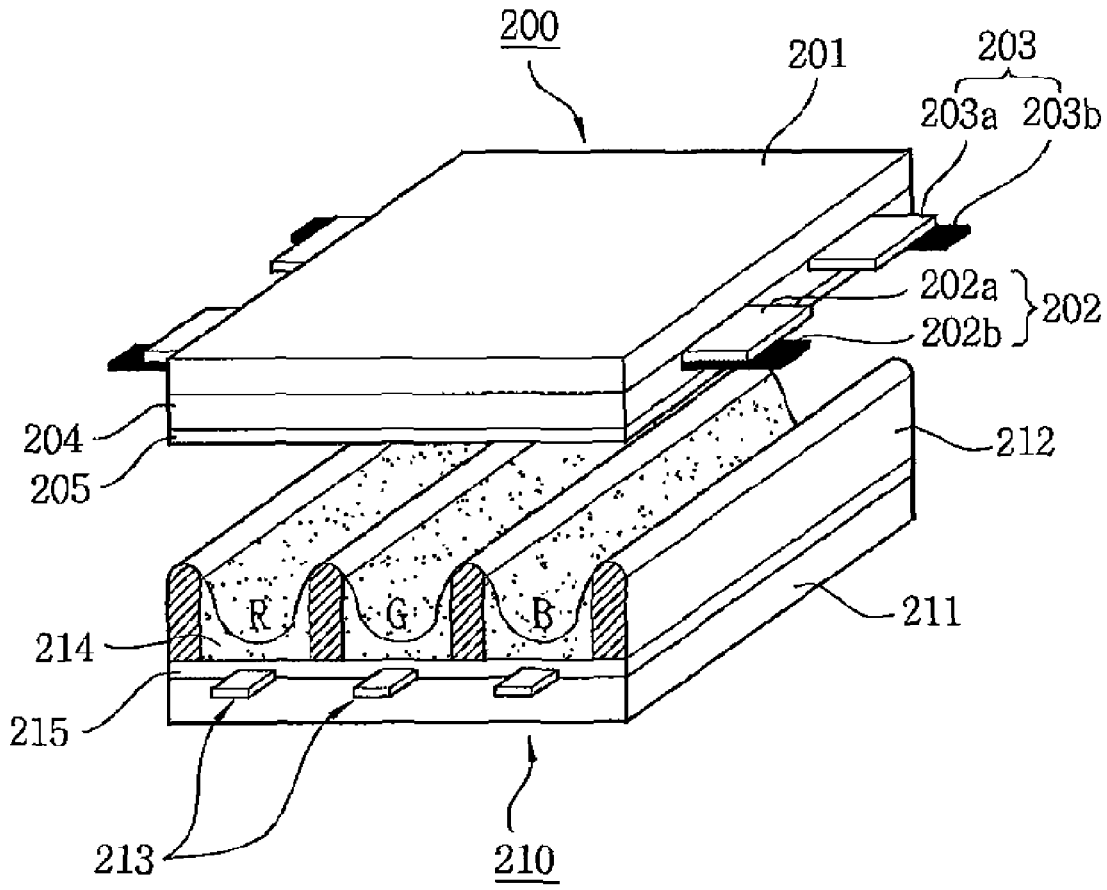
FIG. 2 illustrates the structure of a plasma display panel of FIG. 1.

FIG. 2 illustrates the structure of a plasma display panel of FIG. 1.

As illustrated in FIG. 2, the plasma display panel 100 includes a front panel 200 and a rear panel 210 which are coupled in parallel to oppose to each other at a given distance therebetween. The front panel 200 includes a front substrate 201 on which a plurality of first electrodes 202 and a plurality of second electrodes 203 are formed in pairs. The rear panel 210 includes a rear substrate 211 on which a plurality of third electrodes 213 are positioned to intersect the first electrodes 202 and the second electrodes 203.

The scan electrode 202 and the sustain electrode 203 generate a mutual discharge therebetween in one discharge cell and maintain light-emissions of the discharge cells.

The scan electrode 202 and the sustain electrode 203 need to have light transmittance and electrical conductivity to emit light generated inside the discharge cells and to secure the driving efficiency. Accordingly, the scan electrode 202 and the sustain electrode 203 each include transparent electrodes 202*a* and 203*a* made of a transparent material, for instance, indium-tin-oxide (ITO) and bus electrodes 202*b* and 203*b* made of a metal material.

An upper dielectric layer 204 covering the scan electrode 202 and the sustain electrode 203 is positioned on the front substrate 201. The upper dielectric layer 204 limits a discharge current and providing electrical insulation between the first electrode 202 and the second electrode 203.

A protective layer 205 is formed on an upper surface of the upper dielectric layer 204 to facilitate discharge conditions. The protective layer 205 may be formed through a deposition method using a material having a high secondary electron emission coefficient, for instance, magnesium oxide (MgO).

The address electrode 213 positioned on the rear substrate 211 applies a data signal to the discharge cell. A lower dielectric layer 215 covering the address electrode 213 is positioned on the rear substrate 211.

FIG. 2 illustrated a case where the upper dielectric layer 204 and the lower dielectric layer 215 each have a single-layered structure. However, at least one of the upper dielectric layer 204 and the lower dielectric layer 215 may have a multi-layered structure.

Barrier ribs 212 are positioned on the lower dielectric layer 215 to partition the discharge cells. The discharge cell partitioned by the barrier ribs 212 may have various form such as a well form, a delta form and a honeycomb form.

The discharge cells are coated with a phosphor 214 for emitting visible light for an image display during the generation of an address discharge. The phosphor 214 may include red (R), green (G) and blue (B) phosphors.

FIG. 2 illustrated only an example of the plasma display panel applicable to an exemplary embodiment. Accordingly, an exemplary embodiment is not limited to the structure of the plasma display panel illustrated in FIG. 2. For instance, a black layer (not shown) capable of absorbing external light may be positioned on the barrier rib 212 to prevent the reflection of the external light caused by the barrier rib 212.

FIG. 2 illustrated a case where the plasma display panel includes the scan electrode, the sustain electrode and the address electrode. In an exemplary embodiment, the explanation will be given of an example of the three-electrode type plasma display panel.

Figure 3:
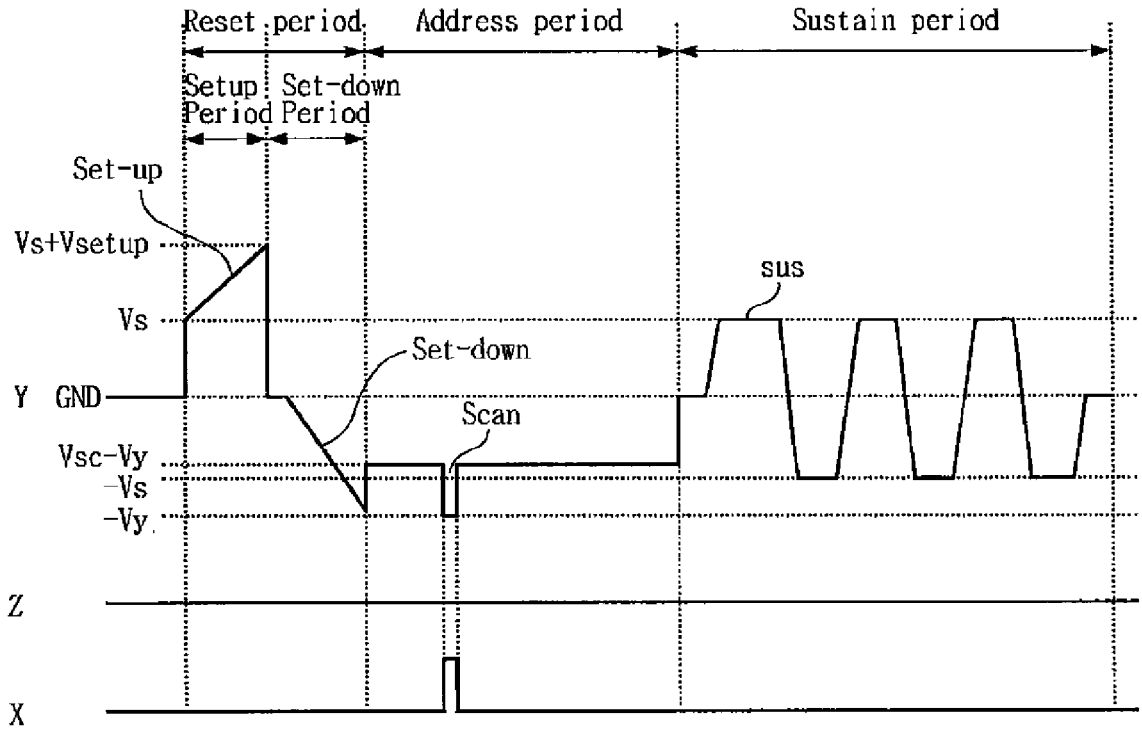
FIG. 3 illustrates a method for driving a plasma display apparatus according to an exemplary embodiment.

FIG. 3 illustrates a method for driving a plasma display apparatus according to an exemplary embodiment.

As illustrated in FIG. 3) the first and second drivers 110 and 120 of FIG. 1 supply driving signals to the scan electrode Y, the sustain electrode Z and the address electrode X during at least one of a reset period, an address period, and a sustain period.

The reset period is divided into a setup period and a set-down period. During the setup period, the first driver 110 may supply a setup signal (Set-up) to the scan electrode Y. The setup signal generates a weak dark discharge within the discharge cells of the whole screen. This results in wall charges of a positive polarity being accumulated on the sustain electrode Z and the address electrode X, and wall charges of a negative polarity being accumulated on the scan electrode Y.

During the set-down period, the first driver 110 may supply a set-down signal (Set-down) which falls from a positive voltage level lower than the highest voltage of the setup signal (Set-up) to a given voltage level lower than a ground level voltage GND to the scan electrode Y, thereby generating a weak erase discharge within the discharge cells. Furthermore, the remaining wall charges are uniform inside the discharge cells to the extent that the address discharge can be stably performed.

During the address period, the first driver 110 may supply a scan signal (Scan) of a negative polarity falling from a scan bias voltage (Vsc−Vy) to the scan electrode Y. The second driver 120 may supply a data signal of a positive polarity to the address electrode X in synchronization with the scan signal (Scan). As a voltage difference between the scan signal (Scan) and the data signal is added to the wall voltage generated during the reset period, an address discharge is generated within the discharge cells to which the data signal is applied. Wall charges are formed inside the discharge cells selected by performing the address discharge to the extent that a discharge occurs whenever a sustain voltage Vs is applied.

During the sustain period, the sustain driver included in the first driver 110 may supply a sustain signal (sus) to the scan electrode Y. As the wall voltage inside the discharge cells selected by performing the address discharge is added to the sustain signal (sus), every time the sustain signal (sus) is applied, a sustain discharge, i.e., a display discharge is generated between the scan electrode Y and the sustain electrode Z.

The first driver 110 supplies a reference voltage to the sustain electrode Z during a period of time ranging from the reset period to the sustain period. The reference voltage may be the ground level voltage GND.

FIG. 3 illustrated only an example of the driving method. Thus, an erase period may be added after the sustain period, and wall charges remaining inside the discharge cells during the sustain period are erased during the erase period. Further, a pre-reset period may be added prior to the reset period, and wall charges inside the discharge cells uniformly remains during the pre-reset period.

Figure 4:
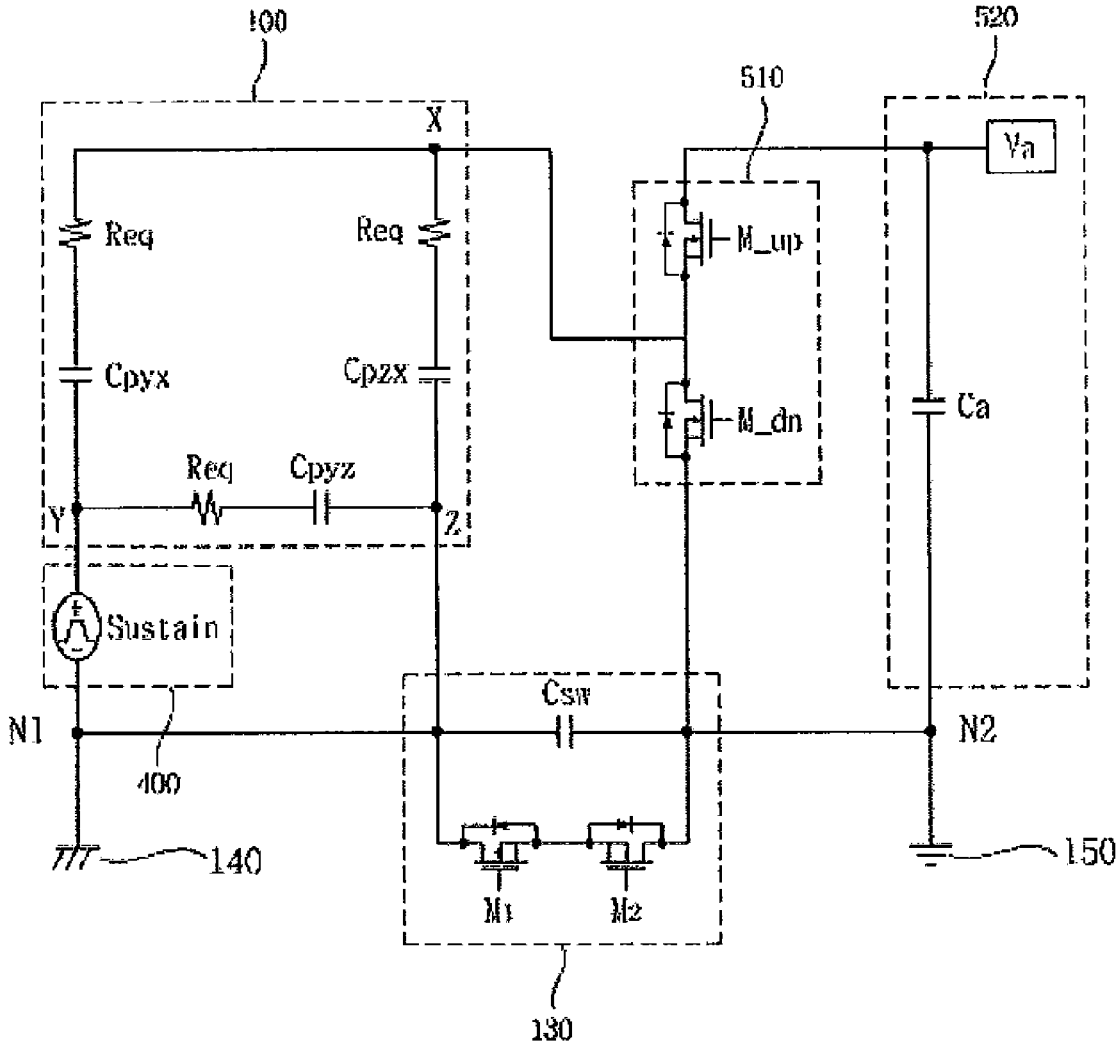
FIG. 4 illustrates an operation of a plasma display apparatus during a sustain period of FIG. 3.

FIG. 4 illustrates an operation of a plasma display apparatus during a sustain period of FIG. 3.

As illustrated in FIG. 4, the plasma display apparatus includes the plasma display panel 100, a sustain driver 400, a data driver 510, a data constant voltage source 520, and the reference separation controller 130.

As described above, the plasma display panel 100 includes a YZ capacitor Cpyz between the scan electrode Y and the sustain electrode Z, a ZX capacitor Cpzx between the sustain electrode Z and the address electrode X, a YX capacitor Cpyx between the scan electrode Y and the address electrode X, and an equivalent resistor Req with respect to the electrodes Y, Z, and X.

One terminal of the sustain driver 400 is connected to the scan electrode Y, and the other terminal is commonly connected to the first reference voltage source 140, the sustain electrode Z, and the reference separation controller 130. Hence, the sustain driver 400 supplies a first or third signal of a positive polarity direction and a second or fourth signal of a negative polarity direction to the scan electrode Y during a bias period.

A power supply (not shown) of the sustain driver 400 is connected to the first reference voltage source 140.

The data driver 510 includes a first switch and a second switch. The first switch indicates a top switch M_up, and the second switch a bottom switch M_dn. One terminal of the top switch M_up is connected to the address electrode X, and the other terminal is connected to the data constant voltage source 520. Hence, the top switch M_up controls to the supply of a data voltage Va output from the data constant voltage source 520 to the address electrode X. One terminal of the bottom switch M_dn is commonly connected to the address electrode X and one terminal of the top switch M_up, and the other terminal is commonly connected to the reference separation controller 130 and the other terminal of the second reference voltage source 150. Hence, the bottom switch M_dn controls the supply of a second reference voltage output from the second reference voltage source 150 to the address electrode X.

A power supply of the data driver 510 may be connected to the second reference voltage source 150 through a capacitor Ca included in the data constant voltage source 520.

The reference separation controller 130 includes reference separation switches M1 and M2. The reference separation controller 130 may include a parasitic capacitor Csw parasitically generated in the reference separation switches M1 and M2.

The reference separation switches M1 and M2 may be a switching element including a body diode. In this case, anodes of body diodes of two switching elements may be connected to each other, or cathodes may be connected to each other.

In other words, FIG. 4 illustrates an equivalent circuit of the reference separation controller 130.

One terminal of each of the reference separation switches M1 and M2 is commonly connected to the other terminal of the sustain driver 400, the first reference voltage source 140, and the sustain electrode Z, and the other terminal is commonly connected to the second reference voltage source 150, the other terminal of the bottom switch M_dn, the data constant voltage source 520. Hence, the reference separation switches M1 and M2 separate the first reference voltage source 140 from the second reference voltage source 150.

For instance, the reference separation controller 130 is turned on while the scan electrode Y is biased to the positive sustain voltage of the first and third signals supplied by the sustain driver 400, so that the first reference voltage source 140 is connected to the second reference voltage source 150. The reference separation controller 130 is turned off during a period of time excluding the bias periods of the first and third signals from supply periods of the first and third signals, so that the first reference voltage source 140 is separated from the second reference voltage source 150.

As above, since the reference separation controller 130 separates the first reference voltage source 140 from the second reference voltage source 150, the sustain driver 400 can cause the address electrode X to be floated during the period of time excluding the bias periods of the first and third signals from the supply periods of the first and third signals.

One terminal of a capacitor Ca included in the data constant voltage source 520 is commonly connected to the data constant voltage source 520 and the other terminal of the top switch M_up, and the other terminal is commonly connected to the other terminal of the bottom switch M_dn, the second reference voltage source 150, and the other terminal of the reference separation controller 130.

Figure 5:
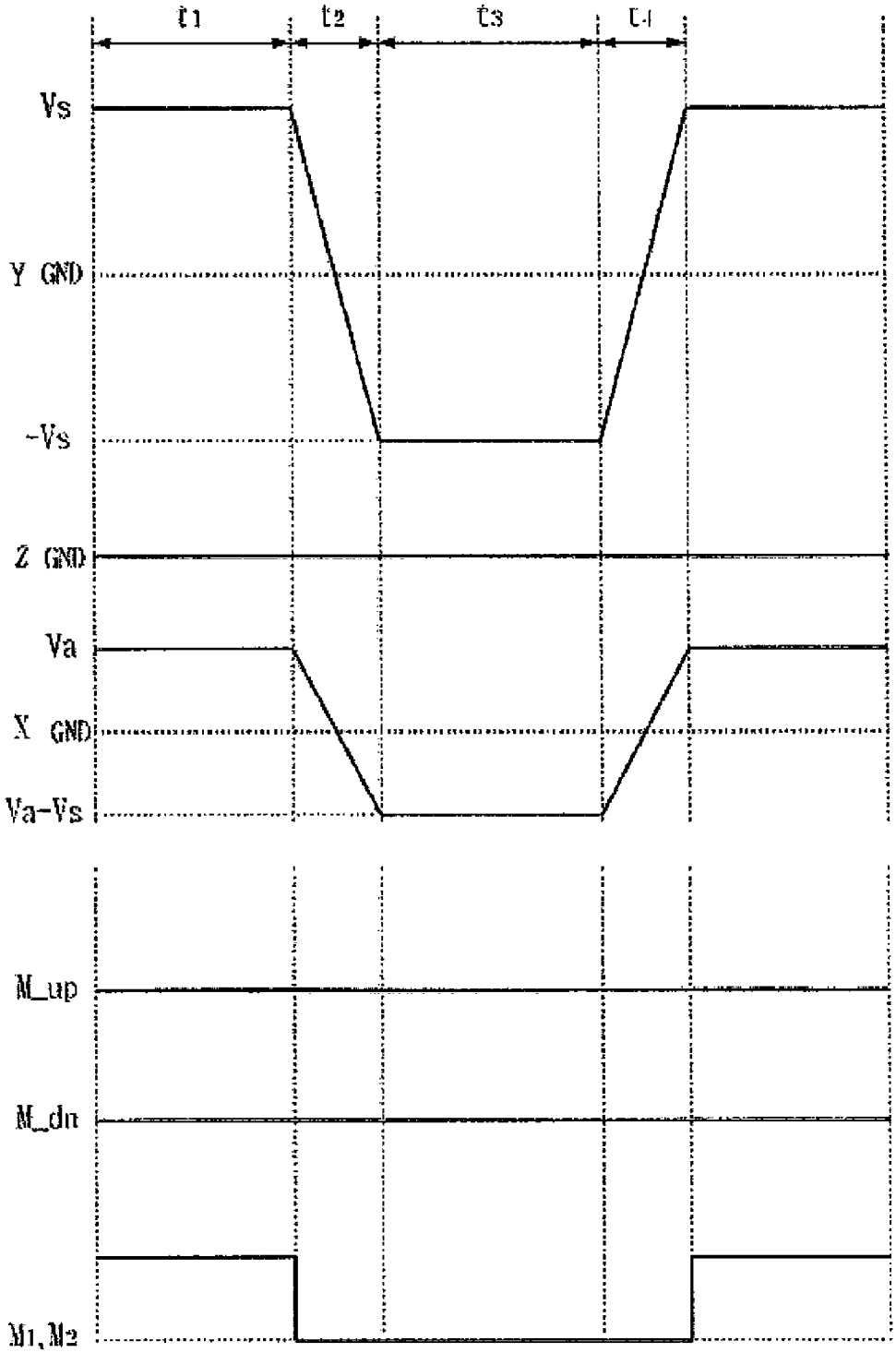
FIG. 5 is a timing diagram for explaining a method for driving a plasma display apparatus during a bias period.

FIG. 5 is a timing diagram for explaining a method for driving a plasma display apparatus during a bias period.

Figure 6A:
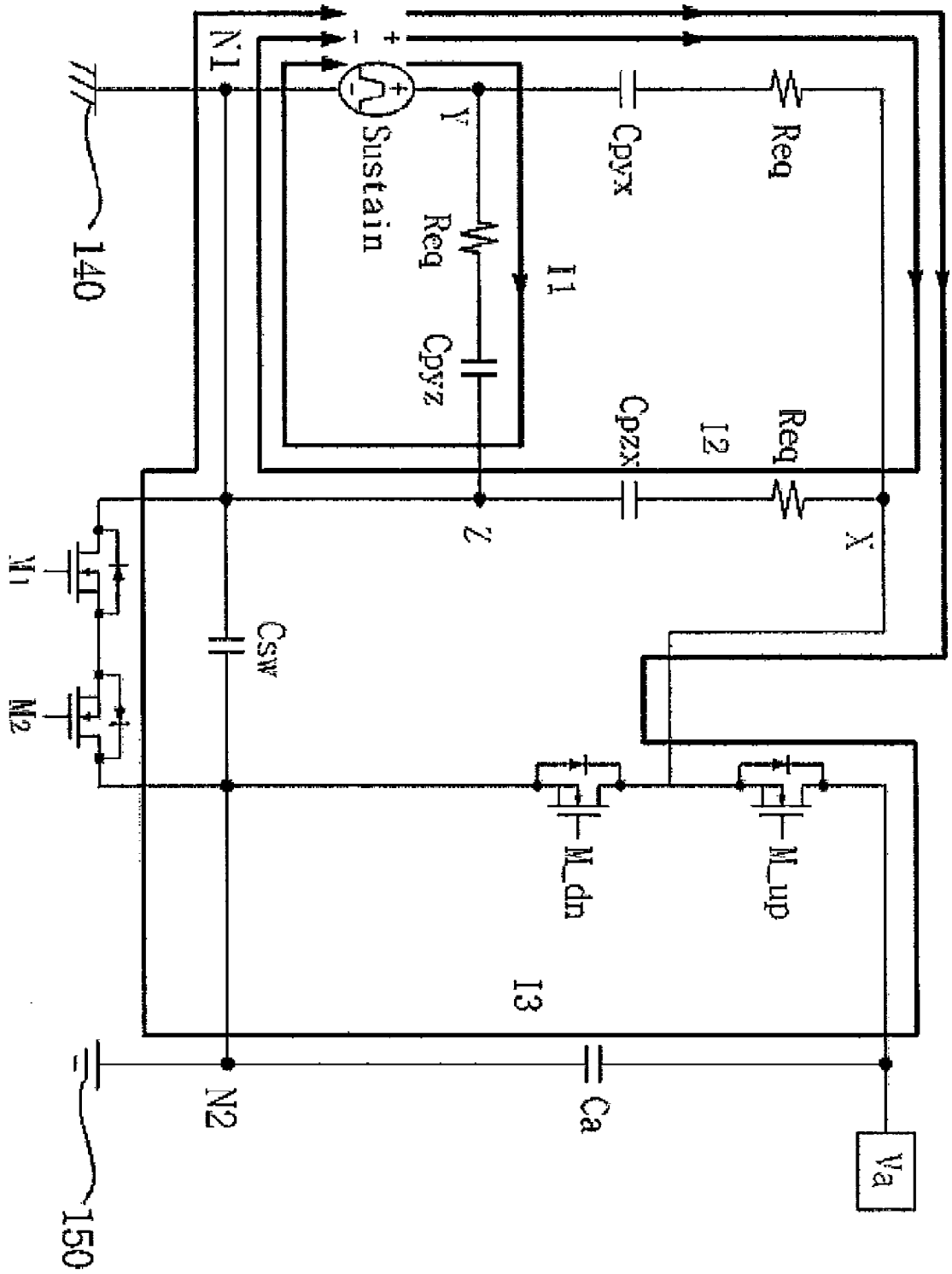
FIGS. 6A to 6C illustrate a method for operating the plasma display apparatus of FIG. 4 depending on the timing diagram of FIG. 5.
Figure 6B:
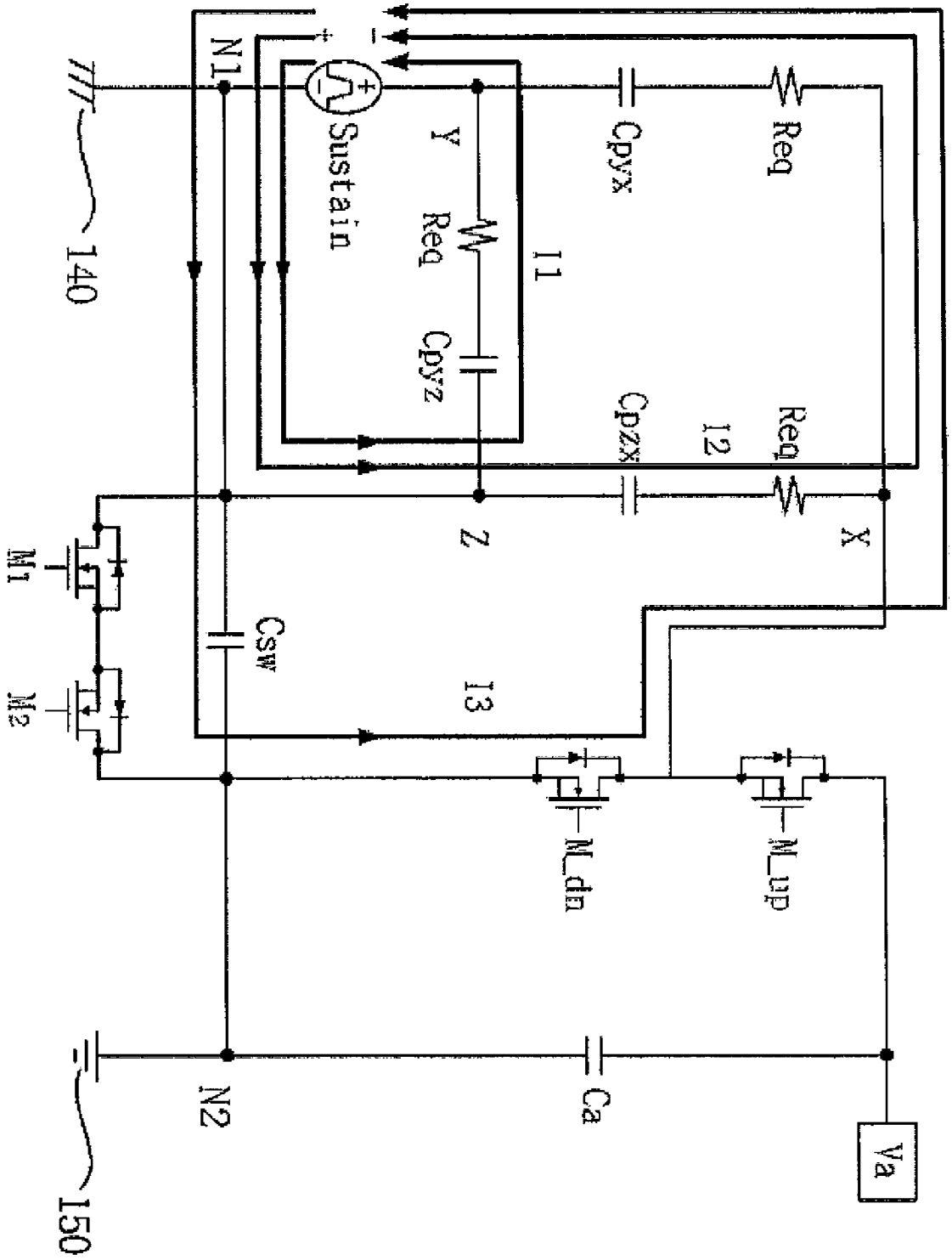
Figure 6C:
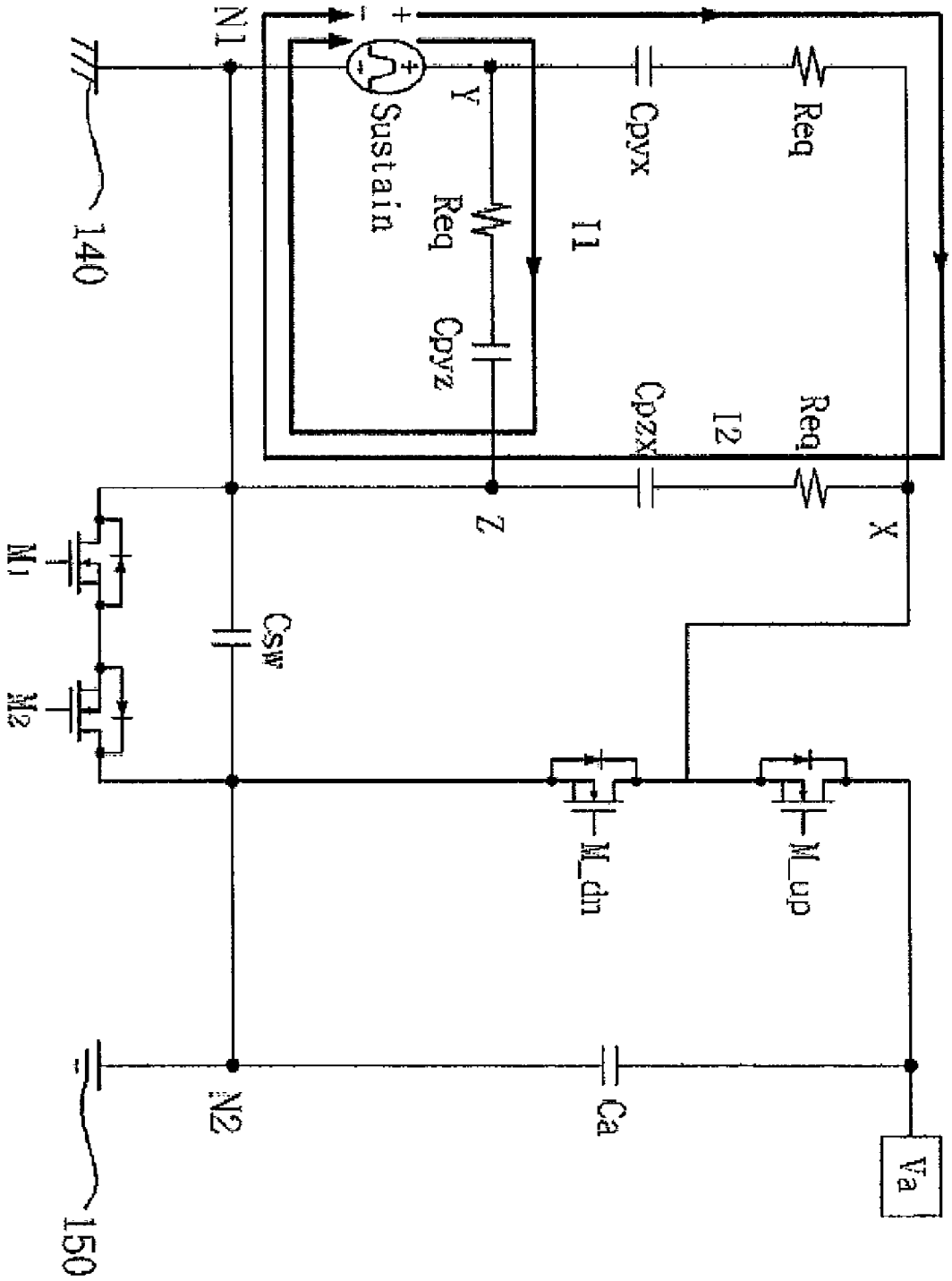

FIGS. 6A to 6C illustrate a method for operating the plasma display apparatus of FIG. 4 depending on the timing diagram of FIG. 5.

As illustrated in FIG. 5, the sustain driver 400 consecutively supplies a first signal of a positive polarity direction having a positive sustain voltage Vs, a second signal of a negative polarity direction having a negative sustain voltage −Vs, a third signal of a positive polarity direction having a positive sustain voltage Vs, and a fourth signal of a negative polarity direction having a negative sustain voltage −Vs to the scan electrode Y based on the first reference voltage source 140 during a bias period.

A magnitude of the positive sustain voltage Vs is substantially equal to a magnitude of the negative sustain voltage −Vs, so that a discharge generated inside turned-on discharge cells is properly maintained.

As above, the sustain electrode Z is connected to the first reference voltage source 140 during a period of time when the sustain driver 400 consecutively supplies the first to fourth signals to the scan electrode Y, thereby receiving a first reference voltage output from the first reference voltage source 140.

The top switch M_up and the bottom switch M_dn are turned off during periods t1, t2, t3, and t4 when the sustain driver 400 consecutively supplies the first to fourth signals to the scan electrode Y, so that the data driver 510 is in a hi-impedance state.

The reference separation switches M1 and M2 are turned on during the period t1 when voltage levels of the first and third signals are maintained at the positive sustain voltage Vs, so that the first reference voltage source 140 is connected to the second reference voltage source 150. Hence, a first node N1 of the first reference voltage source 140 and a second node N2 of the second reference voltage source 150 have an equal voltage level during the period t1. Further, the address electrode X is clamped during the period t1 when the scan electrode Y is biased to the positive sustain voltage Vs of the first and third signals, so that a voltage level of the address electrode X is maintained at the data voltage Va.

A magnitude of the voltage level (i.e., the data voltage Va) of the address electrode X during the period t1 is substantially equal to a magnitude of the data voltage Va of the data signal supplied to the address electrode X during an address period.

During the periods t2, t3 and t4, the reference separation switches M1 and M2 are turned off, so that the first reference voltage source 140 is separated from the second reference voltage source 150. Hence, the first node N1 of the first reference voltage source 140 and the second node N2 of the second reference voltage source 150 may have different voltage levels during the periods t2, t3 and t4. Accordingly, the address electrode X may be caused to be floated.

In such a case, a floating voltage of the address electrode X based on the first reference voltage source 140 is substantially equal to a voltage (Va−Vs) equal to a sum of the data voltage Va and the negative sustain voltage −Vs during the period t3 when the scan electrode Y is biased to the negative sustain voltage −Vs of the second and fourth signals. The first and third signals of the positive polarity and the second and fourth signals of the negative polarity are a sustain signal.

As above, a voltage level of the address electrode X has a voltage swing between the data voltage Va and the voltage (Va−Vs) based on the first reference voltage source 140 during the sustain period when the sustain driver 400 supplies the sustain signal to the scan electrode Y. The data voltage Va and the sustain voltage Vs of the sustain signal have different voltage magnitudes and a substantially equal period.

Further, since a signal having a waveform similar to a waveform of the sustain signal supplied to the scan electrode Y is supplied to the address electrode X during the sustain period, an opposite discharge generated when a discharge repeatedly occurs inside the discharge cells during the sustain period is suppressed.

In case that the opposite discharge is maintained for a long period of time, the phosphor inside the discharge cell may be damaged. As a result the driving characteristic and life span of the plasma display panel are reduced.

More specifically, when a voltage level of the scan electrode Y rises to the positive sustain voltage Vs, as the wall voltage produced inside the discharge cells during the address period is added to the positive sustain voltage Vs, a surface discharge is generated between the scan electrode Y and the sustain electrode Z. In such a case, the opposite discharge does not occur between the scan electrode Y and the address electrode X because the address electrode X is clamped. More specifically, when the voltage Va is supplied to the address electrode X in a clamping state of the address electrode X, the opposite discharge is suppressed due to a reduction in the voltage difference between the scan electrode Y and the address electrode X.

In the same way, when a voltage difference between the scan electrode Y and the sustain electrode Z falls to the negative sustain voltage −Vs, an opposite discharge is suppressed although a voltage level of the address electrode X is the voltage (Va−Vs).

FIG. 6A illustrates a circuit operation of the plasma display apparatus during the period t1. During the period t1, the top switch M_up and the bottom switch M_dn are in a turn-off state, the reference separation switches M1 and M2 are turned on, the sustain driver 400 supplies the positive sustain voltage Vs to the scan electrode Y. Hence, a voltage level of the scan electrode Y is maintained at the positive sustain voltage Vs, and as illustrated in FIG. 6A, first, second and third current paths I1, I2 and I3 may be formed.

Since the top switch M_up and the bottom switch M_dn are in the turn-off state, the data driver 510 is in a hi-impedance state. Accordingly, the data voltage Va of the data constant voltage source 520 may be supplied to the address electrode X through the top switch M_up, or the second reference voltage of the second reference voltage source 150 may not be supplied to the address electrode X through the bottom switch M_dn. When a voltage level of the address electrode X is higher than the data voltage Va, a current flows in an internal diode of the top switch M_up, and thus, a current path is formed. When a voltage level of the address electrode X is lower than the data voltage Va, the current path 13 passing through an internal diode of the bottom switch M_dn is formed.

The reference separation switches M1 and M2 are turned on. Hence, the first node N1 of the first reference voltage source 140 and the second node N2 of the second reference voltage source 150 have an equal voltage level.

The sustain signal of an integrated scan driver is supplied to the scan electrode Y along the first current path I1, and thus, a voltage level of the scan electrode Y is maintained at the positive sustain voltage Vs.

Accordingly, a voltage level of the scan electrode Y is maintained at the positive sustain voltage Vs based on the first reference voltage source 140. Further a voltage level of the sustain electrode Z is equal to the first reference voltage (i.e., 0V) because the first reference voltage of the first reference voltage source 140 is supplied to the sustain electrode Z.

A sum of voltages of the scan, sustain and address electrodes Y, Z and X in the current paths I1 and I2 must be 0 due to Kirchhoffs Current Law (KCL). Therefore, since a voltage difference between the scan electrode Y and the sustain electrode Z is Vs, a sum of a voltage difference between the scan electrode Y and the address electrode X and a voltage difference between the sustain electrode Z and the address electrode X is Vs.

Since the equivalent capacitor Cpyx between the scan electrode Y and the address electrode X and the equivalent capacitor Cpzx between the sustain electrode Z and the address electrode X have substantially equal capacitance, a voltage difference between the scan electrode Y and the address electrode X and a voltage difference between the sustain electrode Z and the address electrode X have an equal voltage of Vs/2. Therefore, a voltage of the address electrode X is Vs/2. However, in this case, a voltage of the address electrode X is clamped from a voltage of Vs/2 to the data voltage Va through the third current path I3.

In other words, when a voltage higher than the data voltage Va is supplied to the address electrode X through the third current path 13, a current flows into an internal diode of the top switch M_up until a voltage level of the address electrode X falls from the voltage higher than the data voltage Va to the data voltage Va. As a result, a voltage of the address electrode X is clamped to the data voltage Va.

Accordingly, since a voltage difference between the scan electrode Y and the address electrode X is equal to Vs−Va and a voltage difference between the sustain electrode Z and the address electrode X is equal to Va, a voltage level of the address electrode X is equal to Va based on the first reference voltage source 140.

In this case, since the scan electrode Y greatly contributes to a discharge, a surface discharge occurs between the scan electrode Y and the sustain electrode Z. Further, because the voltage difference between the scan electrode Y and the address electrode X is reduced to the voltage (Vs−Va) due to the clamping effect, an intensity of an opposite discharge generated between the scan electrode Y and the address electrode X is reduced.

During the periods t2 and t3, the top witch M_up and the bottom switch M_dn are maintained in a turn-off state, the reference separation switches M1 and M2 are turned off, the sustain driver 400 supplies the sustain signal to the sustain electrode Z. In other words, the sustain driver 400 consecutively supplies the first, second, third and fourth signals to the sustain electrode Z. Hence, as illustrated in FIG. 6B, first, second and third current paths I1, I2, and I3 are formed.

During the period t2, the positive sustain voltage Vs supplied to the scan electrode Y delivers from the scan electrode Y to the first reference voltage source 140 along the first current path I1, and the first reference voltage of the first reference voltage source 140 is supplied to the sustain electrode Z. The first reference voltage is higher than a voltage level of the scan electrode Y by a voltage magnitude of Vs.

Accordingly, a voltage level of the scan electrode Y falls from the positive sustain voltage Vs to the negative sustain voltage −Vs based on the first reference voltage source 140. Further, a voltage difference between the scan electrode Y and the sustain electrode Z falls from +Vs to −Vs, and a voltage difference between the scan electrode Y and the address electrode X falls from Vs−Va to −Va.

Further, a voltage difference between the address electrode X and the sustain electrode Z falls from Va to Va−Vs, and a floating voltage of the address electrode X falls from Va to Va−Vs based on the first reference voltage source 140.

At this time, since the first reference voltage is supplied to the sustain electrode Z, a voltage level of the sustain electrode Z is maintained at the first reference voltage based on the first reference voltage source 140.

Accordingly, since the reference separation switches Mt and M2 are turned off, the address electrode X is floated with a floating voltage falling from Va to Va−Vs based on the first reference voltage source 140.

During the period t3, a voltage level of the scan electrode Y falling to the negative sustain voltage −Vs based on the first reference voltage source 140 is maintained at the negative sustain voltage −Vs, and a voltage level of the address electrode X is maintained at Va−Vs.

As above, the floating voltage of the address electrode X is substantially equal to a sum (Va−Vs) of the data voltage Va and the negative sustain voltage −Vs during the period t3 when the negative sustain voltage −Vs is supplied to the scan electrode Y.

In this case, since the sustain electrode Z greatly contributes to a discharge, a surface discharge occurs between the scan electrode Y and the sustain electrode Z. Because the voltage difference between the sustain electrode Z and the address electrode X is reduced to Vs−Va due to a floating of the address electrode X, an intensity of an opposite discharge between the sustain electrode Z and the address electrode X is reduced.

During the period t4, the top witch M_up, the bottom switch M_dn, and the reference separation switches M1 and M2 are maintained in a turn-off state, and the sustain driver 400 supplies the sustain signal to the scan electrode Y. In other words, the sustain driver 400 consecutively supplies the first, second, third and fourth signals to the scan electrode Y.

As illustrated in FIG. 6C, first and second current paths I1 and I2 are formed.

A voltage of the sustain electrode Z is supplied to the scan electrode Y along the first current path I1, and a voltage level of the scan electrode Y rises from the negative sustain voltage −Vs to the positive sustain voltage Vs based on the first reference voltage source 140.

A voltage level of the address electrode X rises from Va−Vs to the data voltage Va based on the first reference voltage source 140.

In this case, the voltage difference between the scan electrode Y and the address electrode X changes from −Va to Vs−Va.

As above, during the periods t2, t3 and t4 except the period t1, the reference separation switches M1 and M2 are turned off, and the address electrode X is floated depending on the sustain signal supplied by the sustain driver 400.

As a result, the opposite discharge is suppressed and a damage to the phosphor is prevented. Further, life span of the plasma display panel 100 can increase. The surface discharge stable occurs, and thus, the driving efficiency during the sustain period can be improved.

Figure 7:
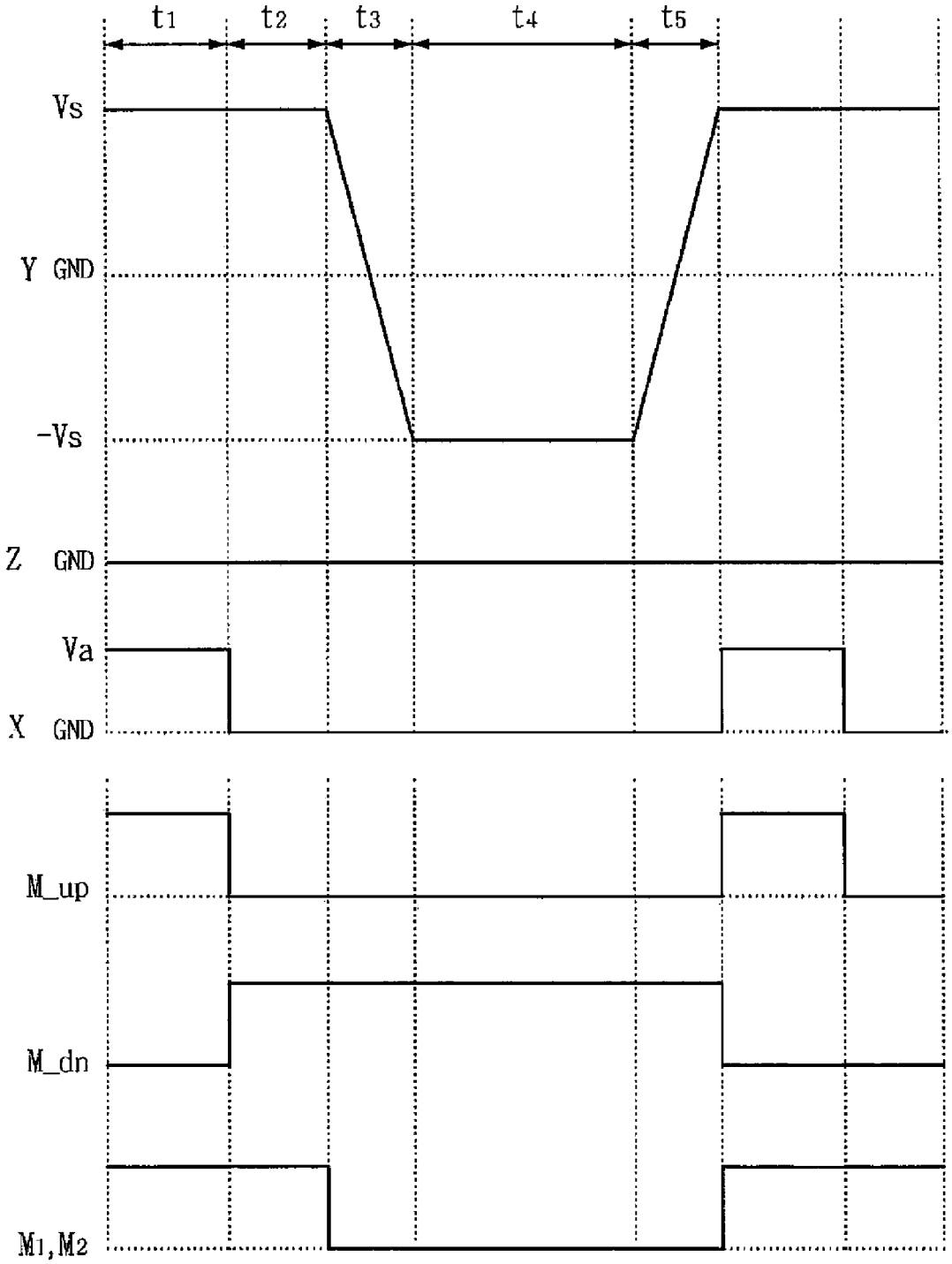
FIG. 7 is a timing diagram for explaining another method for driving a plasma display apparatus during a bias period.

FIG. 7 is a timing diagram for explaining another method for driving a plasma display apparatus during a bias period.

Figure 8A:
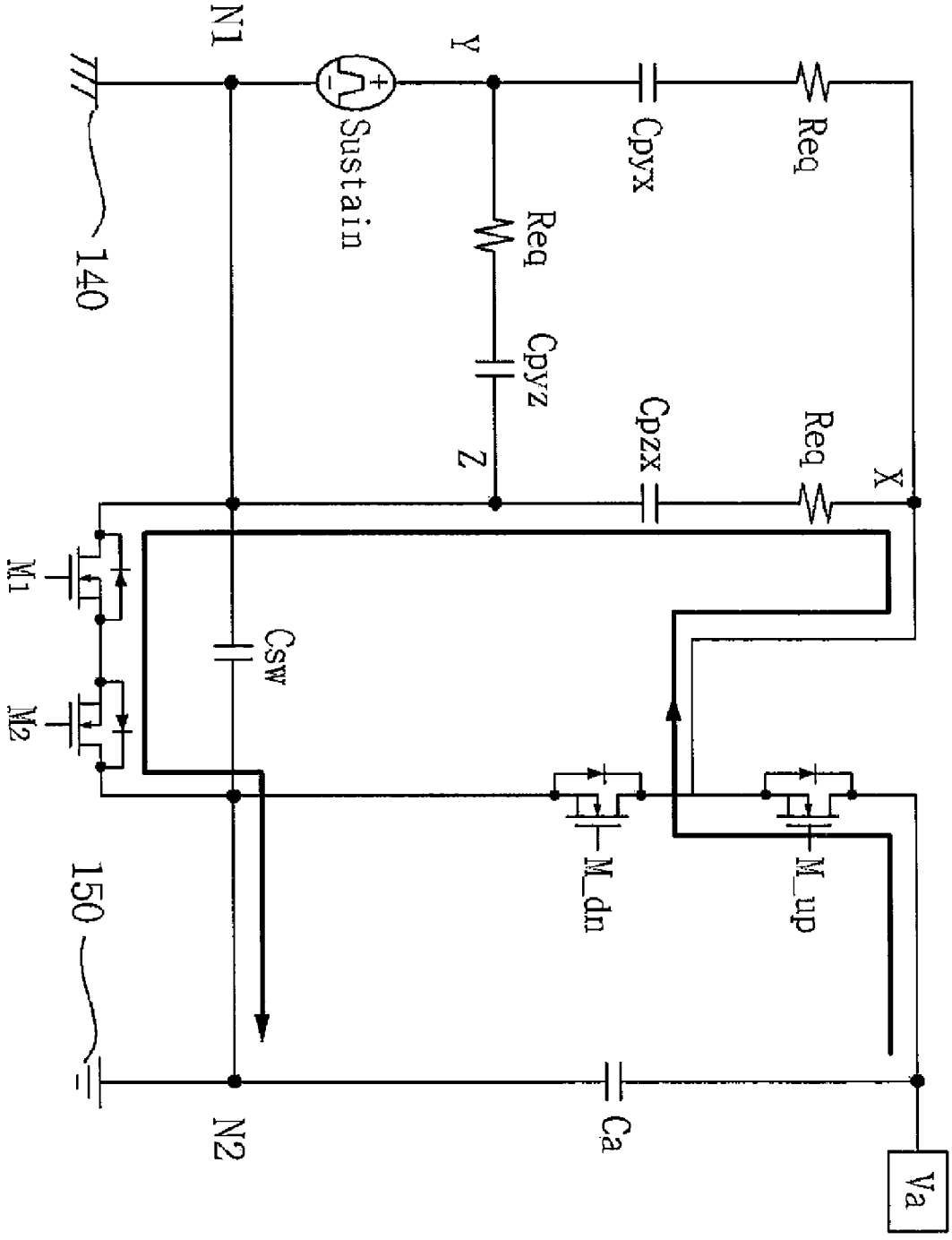
FIGS. 8A to 8C illustrate a method for operating the plasma display apparatus of FIG. 4 depending on the timing diagram of FIG. 7.
Figure 8B:
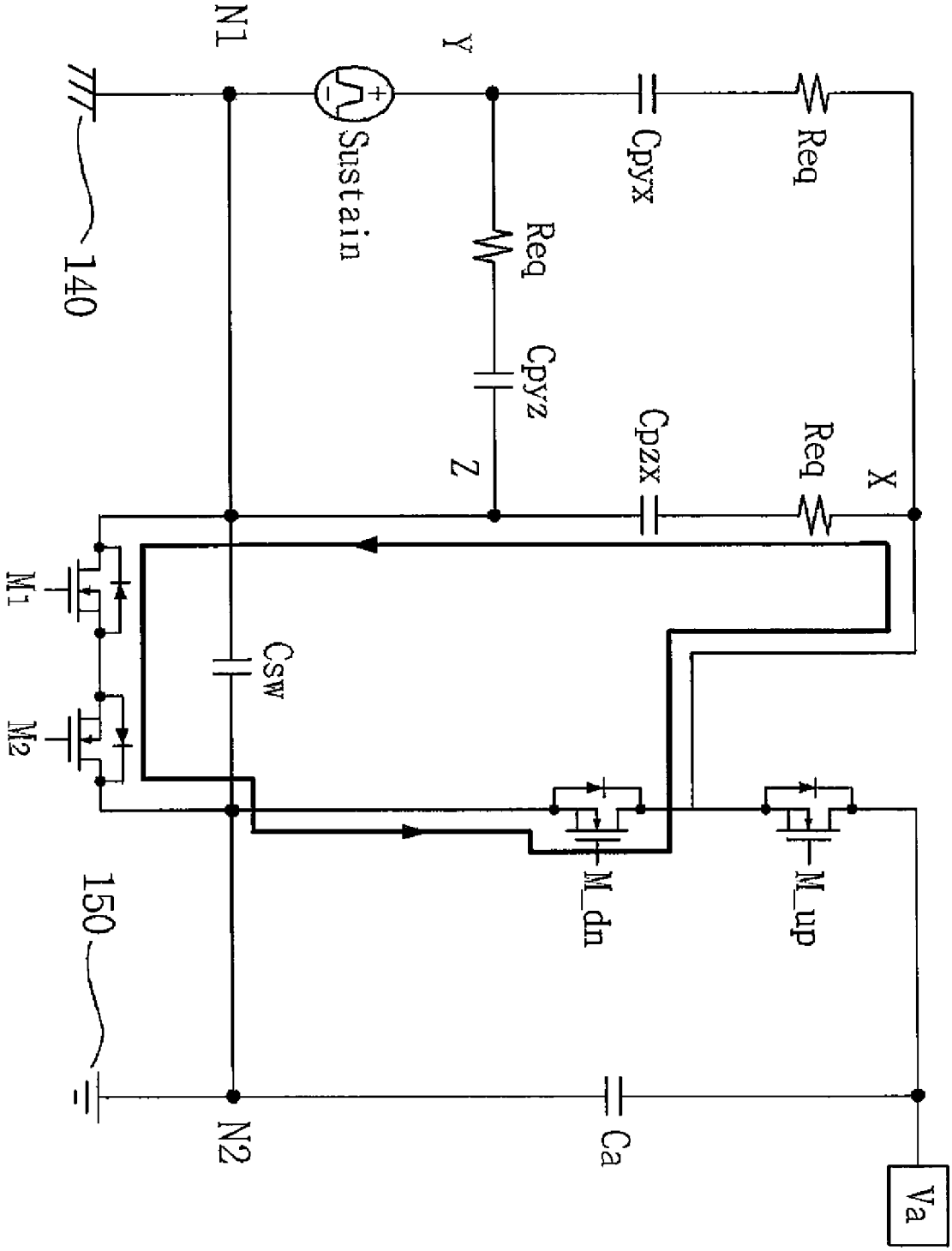
Figure 8C:
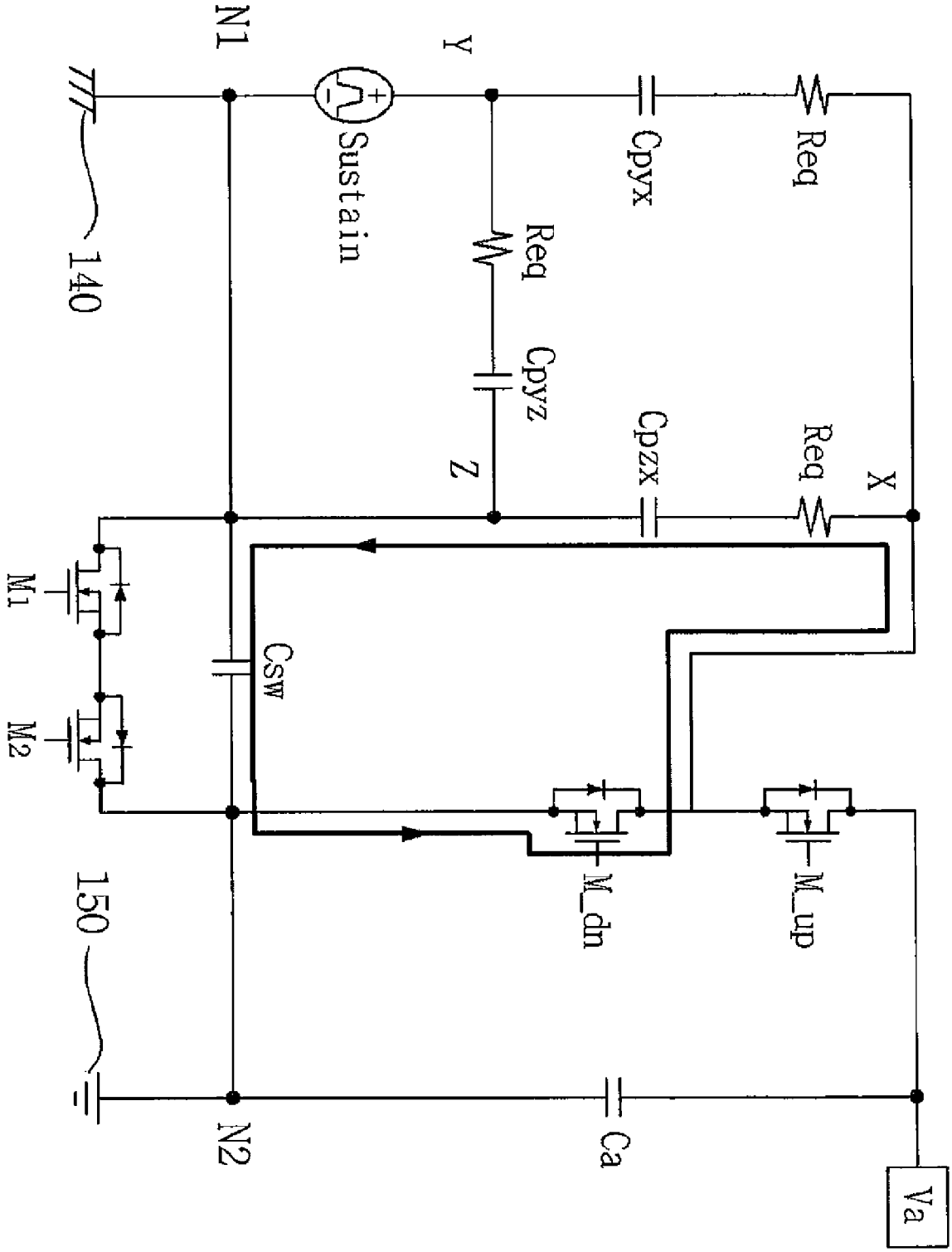

FIGS. 8A to 8C illustrate a method for operating the plasma display apparatus of FIG. 4 depending on the timing diagram of FIG. 7.

As illustrated in FIG. 7, during the bias period, the sustain driver 400 supplies the first to fourth signals to the scan electrode Y based on the first reference voltage source 140, and thus, a voltage level of the scan electrode Y alternately has the voltages Vs and −Vs. Further, a voltage level of the sustain electrode Z is maintained at the first reference voltage based on the first reference voltage source 140.

During periods t1 and t2, the scan electrode Y is biased to the sustain voltage Vs of the first or third signal. During the period t1, the data voltage Va is supplied to the address electrode X. During periods t2 to t5, the second reference voltage is supplied to the address electrode X.

In FIG. 7, a voltage output to the address electrode X corresponds to a voltage level of the address electrode X based on the second reference voltage source 150.

The reference separation switches M1 and M2 are turned on during the periods t1 and t2 when the voltage difference between the scan electrode Y and the sustain electrode Z is maintained at the positive sustain voltage Vs, so that the first reference voltage source 140 is connected to the second reference voltage source 150. The reference separation switches M1 and M2 are turned off during the periods t3 to t5, so that the first reference voltage source 140 is separated from the second reference voltage source 150.

FIG. 8A illustrates a circuit operation of the plasma display apparatus during the period t1. During the period t1, the top switch M_up and the reference separation switches M1 and M2 are turned on, the sustain driver 400 supplies the first and third signals to the scan electrode Y. Hence, a voltage level of the scan electrode Y is maintained at the positive sustain voltage Vs.

Since a current path of the first and third signals supplied to the scan electrode Y was described above, a description thereof is omitted. The data voltage Va supplied to the address electrode X will be described below.

When the top switch M_up and the reference separation switches M1 and M2 are turned on during the period t1, a current path illustrated in FIG. 5A is formed.

The data voltage Va output from the data constant voltage source 520 is supplied to the address electrode X through the top switch M_up along the current path of FIG. 8A.

Since the reference separation switches M1 and M2 are turned on during the period t1, the first node N1 of the first reference voltage source 140 and the second node N2 of the second reference voltage source 150 have a substantially equal voltage level.

During the period t2, the bottom switch M_dn is turned on and the reference separation switches M1 and M2 are maintained in a turn-on state. Hence, a current path illustrated in FIG. 8B is formed.

The data driver 510 supplies the second reference voltage output from the second reference voltage source 150 to the address electrode X along the current path of FIG. 8B. In this case, since the reference separation switches M1 and M2 are turned on during the period t2, the first node N1 of the first reference voltage source 140 and the second node N2 of the second reference voltage source 150 have a substantially equal voltage level.

During the period t3, the bottom switch M_dn is maintained in a turn-on state, and the reference separation switches M1 and M2 are turned off. Hence, a current path illustrated in FIG. 8C is formed.

Since the first reference voltage source 140 and the second reference voltage source 150 are separated from each other during the period t3, the first node N1 and the second node N2 have different voltage levels.

However, a voltage level of the address electrode X is equal to the second reference voltage of the second reference voltage source 150 because the bottom switch M_dn is maintained in a turn-on state.

During the periods t4 and t5, the current path illustrated in FIG. 8C is formed.

Figure 9:
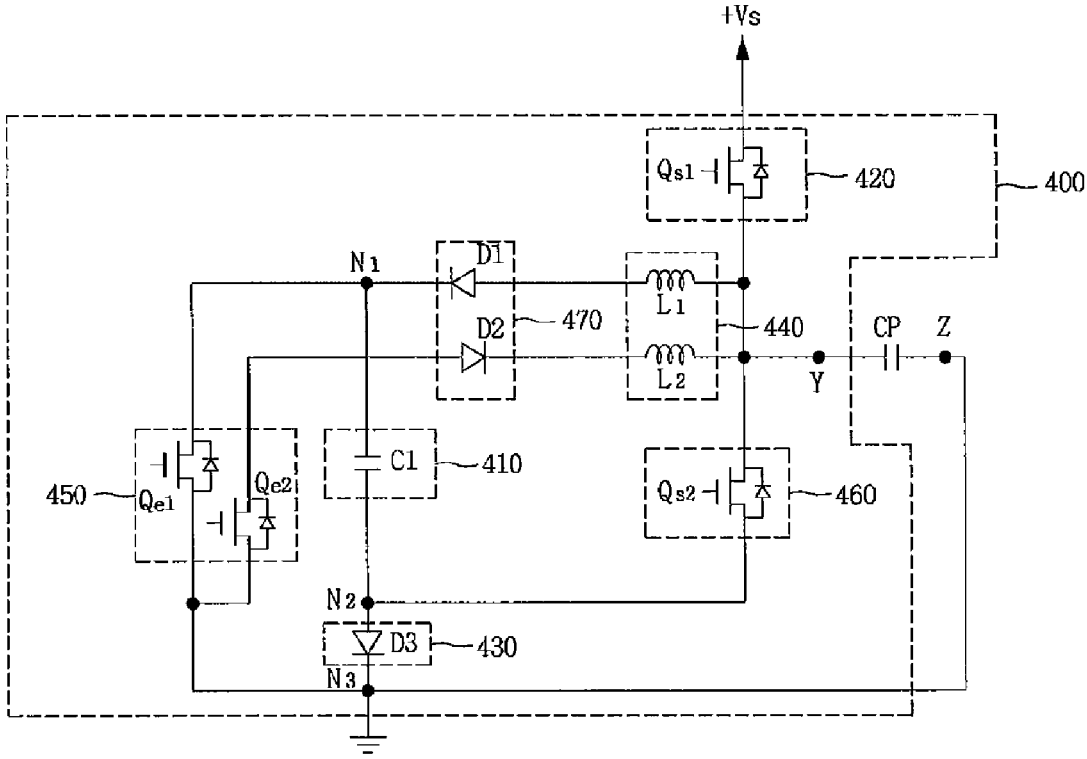
FIG. 9 illustrates a sustain driver included in a first driver of a plasma display apparatus according to an exemplary embodiment.

FIG. 9 illustrates a sustain driver included in a first driver of a plasma display apparatus according to an exemplary embodiment.

As illustrated in FIG. 9, the sustain driver 400 includes a capacitor unit 410, a first sustain controller 420, a voltage maintenance unit 430, an inductor unit 440, a resonance controller 450, a second sustain controller 460, and a reverse current blocking unit 470.

The capacitor unit 410 includes a capacitor C1 charging a voltage.

The first sustain controller 420 includes a first sustain switch Qs1. The first sustain controller 420 supplies a positive sustain voltage output from a positive voltage source +Vs to the scan electrode Y, and at the same time, charges the positive voltage source +Vs to one terminal of the capacitor C1.

The voltage maintenance unit 430 includes a diode D3. The voltage maintenance unit 430 prevents a reverse current to maintain a voltage charged to the capacitor C1.

The inductor unit 440 includes a first inductor L1 and a second inductor L2. The inductor unit 440 and the plasma display panel Cp form resonance. The first inductor L1 and the plasma display panel Cp form resonance so that a voltage level of the scan electrode Y changes from the positive sustain voltage Vs to the negative sustain voltage −Vs. The second inductor L2 and the plasma display panel Cp form resonance so that a voltage level of the scan electrode Y changes from the negative sustain voltage Vs to the positive sustain voltage Vs.

The resonance controller 450 includes a first resonance switch Qe1 and a second resonance switch Qe2. The resonance controller 450 controls a voltage level of the scan electrode Y through resonance. More specifically, the first resonance switch Qe1 controls a voltage level of the scan electrode Y to change from the positive sustain voltage Vs to the negative sustain voltage −Vs through resonance between the panel Cp and the inductor unit 440. The second resonance switch Qe2 controls a voltage level of the scan electrode Y to change from the negative sustain voltage −Vs to the positive sustain voltage Vs through resonance between the panel Cp and the inductor unit 440.

The second sustain controller 460 includes a second sustain switch Qs2. The second sustain controller 460 supplies the negative sustain voltage −Vs of the other terminal of the capacitor C1 to the scan electrode Y, and thus, a voltage level of the scan electrode Y is maintained at the negative sustain voltage −Vs.

The reverse current blocking unit 470 includes a first diode D1 and a second diode D2, and is electrically connected to the inductor unit 440 and the resonance controller 450 to block a reverse current. The first diode D1 blocks a reverse current flowing from the first resonance switch Qe1 to the first inductor L1, and the second diode D2 blocks a reverse current flowing from the second inductor L2 to the second resonance switch Qe2.

Since the sustain electrode Z is electrically connected to the reference voltage source, a voltage of the reference voltage source is supplied to the sustain electrode Z during the supply of the positive sustain voltage Vs and the negative sustain voltage −Vs to the scan electrode Y.

As above, since a separate driver for supplying the driving signals to the sustain electrode Z is not necessary, the fabrication cost is reduced.

A period during which the positive sustain voltage Vs is supplied to the scan electrode Y and at the same time, the positive sustain voltage Vs is charged to one terminal of the capacitor C1 may be different from a period during which the negative sustain voltage −Vs of the other terminal of the capacitor C1 is supplied to the scan electrode Y.

Accordingly, although the sustain load increases, a voltage drop can be prevented by stably charging a voltage to the capacitor C1.

Figure 10:
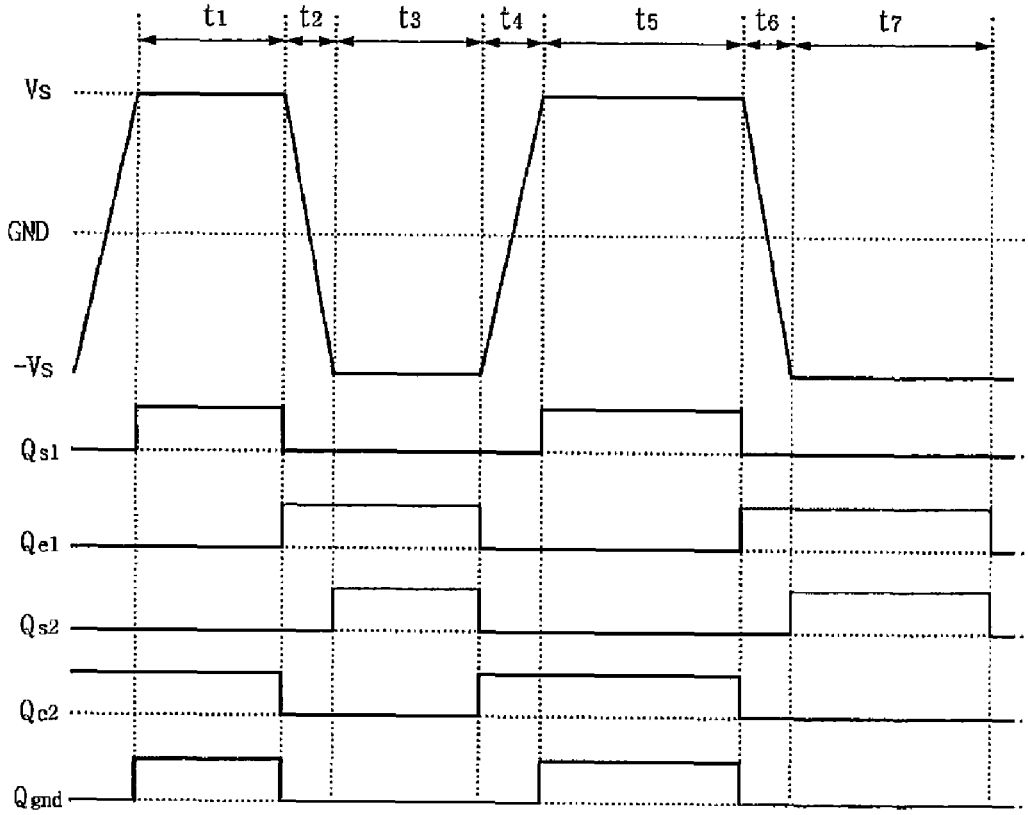
FIG. 10 illustrates one implementation of a driving timing diagram of the plasma display panel by the sustain driver of FIG. 9.

FIG. 10 illustrates one implementation of a driving timing diagram of the plasma display panel by the sustain driver of FIG. 9.

Referring to FIGS. 9 and 10, Vy indicates a voltage of the scan electrode Y based on the first reference voltage source, and Vz indicates a voltage of the sustain electrode Z based on the first reference voltage source.

A method for driving the plasma display apparatus according to an exemplary embodiment includes turning on the first sustain controller 420 to supply the positive sustain voltage Vs to the scan electrode Y and to charge the positive sustain voltage Vs to one terminal of the capacitor C1 during a period t1; turning on the resonance controller 450 to lower a voltage level of the scan electrode Y from the positive sustain voltage Vs to the negative sustain voltage −Vs through resonance between the panel CP and the inductor unit 440 during a period t2; turning on the second sustain controller 460 to supply the negative sustain voltage −Vs of the other terminal of the capacitor C1 to the scan electrode Y during a period t3; and turning on the resonance controller 450 to raise a voltage level of the scan electrode Y from the negative sustain voltage −Vs to the positive sustain voltage Vs through resonance between the panel CP and the inductor unit 440 during a period t4. The above-described operations are repeatedly performed during periods (for instance, periods t5, t6 and t7) which follow the period t4.

During a period t1, the supply of the positive sustain voltage Vs to the scan electrode Y and the charging of the positive sustain voltage Vs to one terminal of the capacitor C1 may be subsequently performed.

A duration of a period of time during which the positive sustain voltage Vs is charged to one terminal of the capacitor C1 may be shorter than or equal to a duration of a period of time during which the negative sustain voltage −Vs of the other terminal of the capacitor C1 is supplied to the scan electrode Y.

A duration of the period t3 during which the scan electrode Y is biased to the negative sustain voltage −Vs of the second signal may be substantially equal to or longer than a duration of the period t1 during which the scan electrode Y is biased to the positive sustain voltage Vs of the first signal.

As a result, a surface discharge occurs more stably, and a driving margin is secured.

During the period t1, the second resonance switch Qe2 is maintained in a turn-on state and the first sustain switch Qs1 is turned on. Hence, the positive sustain voltage Vs is supplied to the scan electrode Y and is charged to one terminal of the capacitor C1.

A voltage level having a voltage magnitude substantially equal to a positive voltage level is charged to one terminal and between both terminals of the capacitor C1. A magnitude of the charging voltage is maintained although there is a change in a magnitude of a voltage charged to one terminal or the other terminal of the capacitor C1. For instance, in case that a voltage of one terminal of the capacitor C1 increases, a voltage of the other terminal of the capacitor C1 also increases while the magnitude of the charging voltage is maintained.

The positive sustain voltage Vs is supplied to the scan electrode Y. The magnitude of the positive sustain voltage Vs is equal to a magnitude of the sustain voltage capable of generating a sustain discharge inside the discharge cell.

The first node N1 has a voltage magnitude equal to the positive sustain voltage Vs, and the second and third nodes N1 and N3 have a voltage magnitude equal to the first reference voltage GND. The positive sustain voltage Vs supplied to the scan electrode Y has a voltage magnitude equal to the sustain voltage, and the sustain electrode Z has a voltage magnitude equal to the first reference voltage GND. Accordingly, a voltage level of the scan electrode Y is maintained at the positive sustain voltage Vs based on the first reference voltage source 140.

The reason why the second resonance switch Qe2 is maintained in a turn-on state during the period t1 is a stable circuit operation of the plasma display apparatus. Accordingly, the second resonance switch Qe2 may be turned on during a portion of the period t1, or may be turned off during the period t1.

The first resonance switch Qe1 is turned on during the period t2. Hence, a voltage level of the scan electrode Y falls from the positive sustain voltage Vs to the negative sustain voltage Vs through resonance.

The voltage supplied to the scan electrode Y is supplied to the sustain electrode Z through resonance between the first inductor L1 and the panel Cp. Since both terminals of the capacitor C1 cannot form a current path due to the third diode D3, a voltage stored in the capacitor C1 is not changed. Accordingly, a voltage level of the scan electrode Y falls from the positive sustain voltage Vs to the negative sustain voltage −Vs having a voltage magnitude equal to the sustain voltage based on the first reference voltage source 140.

A voltage of the first node N1 is 0V, a voltage of the second node N2 is the negative sustain voltage −Vs because a difference between voltages charged to both terminals of the capacitor C1 has to be maintained, and a voltage of the third node N3 is 0V equal to the first reference voltage in a state of the falling of a voltage level of the scan electrode Y from the positive sustain voltage Vs to the negative sustain voltage −Vs.

The first reference voltage is supplied to the sustain electrode Z based on the first reference voltage source 140.

The first resonance switch Qe1 is maintained in a turn-on state, and the second sustain switch Qs2 is turned on during the period t3. Hence, the negative sustain voltage of the other terminal of the capacitor C1 is supplied to the scan electrode Y.

The scan electrode has a voltage magnitude equal to the negative sustain voltage −Vs based on the first reference voltage source 140. At this time, a voltage of the first node N1 is 0V, a voltage of the second node N2 is the negative sustain voltage −Vs because a difference between voltages charged to both terminals of the capacitor C1 has to be maintained, and a voltage of the third node N3 is 0V equal to the first reference voltage.

In other words, the negative sustain voltage −Vs of the second node N2 is supplied to the scan electrode Y through the second sustain switch Qs2. The third diode D3 blocks a current flowing from the third node N3 to the second node N2. The reason is that a voltage of the third node N3 is higher than a voltage of the second node N2.

A voltage level of the sustain electrode Z is equal to the first reference voltage GND.

The second resonance switch Qe2 is turned on during the period t4. Hence, a voltage level of the scan electrode Y rises from the negative sustain voltage −Vs to the positive sustain voltage Vs through resonance.

In other words, a voltage supplied to the sustain electrode Z is supplied to the scan electrode Y through resonance between the second inductor L2 and the panel Cp. Hence, a voltage level of the scan electrode Y rises from the negative sustain voltage −Vs to the positive sustain voltage Vs through resonance.

The scan electrode Y is driven by the sustain driver 400.

The operation of the plasma display panel during the bias periods t1 and t2 of the first signal and the bias periods t3 and t4 of the second signal was described above. Since the operation of the plasma display panel during bias periods t5 and t6 of the third signal and a bias period t7 of the fourth signal is approximately the same as the operation of the plasma display panel during the bias periods t1 and t2 and the bias periods t3 and t4, a description thereof is omitted.

During a sustain period of one subfield, the first signal of the positive polarity direction, the second signal of the negative polarity direction, the third signal of the positive polarity direction, and the fourth signal of the negative polarity direction are consecutively supplied to the scan electrode. A duration of a bias period of the first signal is shorter than a duration of a bias period of the third signal.

The bias period of the first signal may be substantially equal to a bias period of the second signal. Hence, a driving margin of the plasma display panel driven by the sustain driver is easily secured.

A sum of the bias period of the first signal and the bias period of the third signal may be substantially equal to a sum of the bias period of the second signal and the bias period of the fourth signal. In other words, a period of time during which the scan electrode is biased to the positive sustain voltage Vs may be substantially equal to a period of time during which the scan electrode is biased to the negative sustain voltage −Vs. Accordingly, a difference between the quantity of light generated by the positive sustain voltage Vs and the negative sustain voltage −Vs can be reduced, and thus the quantity of light can be uniformly maintained.

The remaining period subtracting the bias period t1 of the first signal from the supply period of the first signal may be substantially equal to the remaining period subtracting the bias period t2 of the second signal from the supply period of the second signal. An interval between discharge start time points can be kept constant by setting a period of time required to change from the positive sustain voltage Vs to the negative sustain voltage −Vs to be equal to a period of time required to change from the negative sustain voltage −Vs to the positive sustain voltage Vs. Accordingly, an erroneous discharge caused by discharge delay can be reduced.

In other words, during a sustain period of one subfield, in a first sustain signal having a first maintaining period t1 during which a voltage level of the scan electrode Y is maintained at the positive sustain voltage Vs and a second maintaining period t3 during which a voltage level of the scan electrode Y is maintained at the negative sustain voltage −Vs, a duration of the first maintaining period t1 is equal to a duration of the second maintaining period t3. In a second sustain signal having a third maintaining period t5 during which a voltage level of the scan electrode Y is maintained at the positive sustain voltage Vs and a fourth maintaining period t7 during which a voltage level of the scan electrode Y is maintained at the negative sustain voltage −Vs, a duration of the third maintaining period t5 is equal to a duration of the fourth maintaining period t7. The duration of the second maintaining period t3 may be equal to the duration of the third maintaining period t5, but at least one of the periods t1, t3, t5 and t7 must be different from the duration of the remaining periods. Accordingly, a duration of a period is equal to or shorter than a duration of another period which follows the period. Hence, a driving margin of the plasma display panel driven by the sustain driver is easily secured.

A sum of the first maintaining period t1 and the third maintaining period t5 may be substantially equal to a sum of the second maintaining period t3 and the fourth maintaining period t7. In other words, a total period of time during which a voltage level of the scan electrode Y is maintained at the positive sustain voltage Vs may be substantially equal to a total period of time during which a voltage level of the scan electrode Y is maintained at the negative sustain voltage −Vs. Accordingly, a difference between the quantity of light generated by the positive sustain voltage Vs and the negative sustain voltage −Vs can be reduced, and thus the quantity of light can be uniformly maintained.

Accordingly, a duration of a period of the sustain signal generated during a sustain period of one subfield may be constant or become longer. For instance, the second sustain signal may occur subsequent to the first sustain signal. A duration of a period of the first sustain signal may be shorter than or equal to a duration of a period of the second sustain signal. This reason is that the first and second sustain signals each have a different sustain voltage maintaining time interval.

Figure 11:
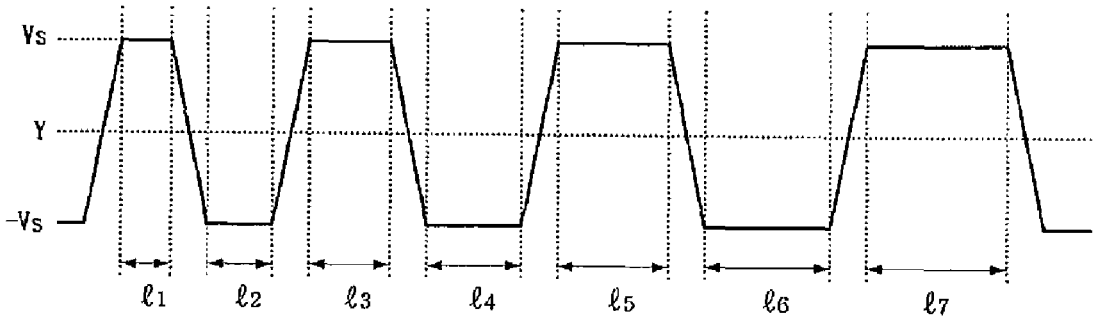
FIG. 11 illustrates another implementation of a driving timing diagram of the plasma display panel by the sustain driver of FIG. 9.

FIG. 11 illustrates another implementation of a driving timing diagram of the plasma display panel by the sustain driver of FIG. 9.

As illustrated in FIG. 11, during a sustain period of one subfield, in a first sustain signal having a first maintaining period l1 during which a voltage level of the scan electrode Y is maintained at the positive sustain voltage Vs and a second maintaining period l2 during which a voltage level of the scan electrode Y is maintained at the negative sustain voltage −Vs, a duration of the second maintaining period l2 is longer than a duration of the first maintaining period l1. In a second sustain signal having a third maintaining period l3 during which a voltage level of the scan electrode Y is maintained at the positive sustain voltage Vs and a fourth maintaining period l4 during which a voltage level of the scan electrode Y is maintained at the negative sustain voltage −Vs, a duration of the fourth maintaining period l4 is longer than a duration of the third maintaining period l3. The duration of the third maintaining period l3 is longer than the duration of the second maintaining period l2.

As the sustain period elapses from the first to seventh maintaining periods l1 to l7, the durations of the maintaining periods become longer. Hence, a driving margin of the plasma display panel driven by the sustain driver is easily secured.

In other words, the duration of the bias period of the second signal may be longer than the duration of the bias period of the first signal, and may be shorter than the duration of the bias period of the third signal. The duration of the bias period of the second signal may be shorter than the duration of the bias period of the fourth signal.

As above, in the plasma display apparatus according to an exemplary embodiment, a driving margin is secured and the performance of the plasma display panel depending on an APL is improved by gradually increasing a duration of a sustain voltage maintaining period in a sustain period of one subfield.

The foregoing embodiments and advantages are merely exemplary and are not to be construed as limiting the present invention. The present teaching can be readily applied to other types of apparatuses. The description of the foregoing embodiments is intended to be illustrative, and not to limit the scope of the claims. Many alternatives, modifications, and variations will be apparent to those skilled in the art.

What is claimed is:

1. A plasma display apparatus comprising:

a plasma display panel including a first electrode, a second electrode, and a third electrode;

a data driver that supplies a data signal to the third electrode during an address period; and a sustain driver that consecutively supplies a first signal of a positive polarity direction, a second signal of a negative polarity direction, a third signal of a positive polarity direction, and a fourth signal of a negative polarity direction to the first electrode and supplies a reference voltage to the second electrode during a sustain period, a duration of a bias period of the first signal being shorter than a duration of a bias period of the third signal.

2. The plasma display apparatus of claim 1, wherein the reference voltage is a ground level voltage.

3. The plasma display apparatus of claim 1, wherein the duration of the bias period of the first signal is substantially equal to a duration of a bias period of the second signal.

4. The plasma display apparatus of claim 1, wherein a sum of the duration of the bias period of the first signal and the duration of the bias period of the third signal is substantially equal to a sum of a duration of a bias period of the second signal and a duration of a bias period of the fourth signal.

5. The plasma display apparatus of claim 1, wherein a duration of the remaining period subtracting the bias period of the first signal from a supply period of the first signal is substantially equal to a duration of the remaining period subtracting a bias period of the second signal from a supply period of the second signal.

6. The plasma display apparatus of claim 1, wherein a duration of a bias period of the second signal is longer than the duration of the bias period of the first signal, and is shorter than the duration of the bias period of the third signal.

7. The plasma display apparatus of claim 1, wherein a duration of a bias period of the second signal is shorter than a duration of a bias period of the fourth signal.

8. The plasma display apparatus of claim 1, wherein the sustain driver supplies a first voltage output from a positive voltage source to the first electrode and at the same time, charges the first voltage to a capacitor, and the sustain driver supplies a second voltage to the first electrode through the capacitor.

9. The plasma display apparatus of claim 8, wherein a period of time during which the first voltage is charged to the capacitor is different from a period of time during which the second voltage is supplied to the first electrode through the capacitor.

10. The plasma display apparatus of claim 1, further comprising a reference separation controller that electrically separates or connects a first reference voltage source commonly connected to the sustain driver and the second electrode from or to a second reference voltage source connected to the data driver.

11. The plasma display apparatus of claim 10, wherein the reference separation controller is turned on during the bias period of the first or third signal, so that the first reference voltage source is connected to the second reference voltage source, and the reference separation controller is turned off during a period of time excluding the bias period of the first or third signal from a supply period of the first or third signal, so that the first reference voltage source is separated from the second reference voltage source.

12. The plasma display apparatus of claim 10, wherein the data driver includes a first switch and a second switch, and the first switch controls the supply of a data voltage output from a data constant voltage source to the third electrode, and the second switch controls the supply of a second reference voltage output from the second reference voltage source to the third electrode.

13. The plasma display apparatus of claim 12, wherein the first switch and the second switch are turned off during a period of time when the first to fourth signals are supplied to the first electrode, so that the data driver is in a hi-impedance state.

14. The plasma display apparatus of claim 12, wherein the third electrode is clamped during the bias period of the first or third signal, so that a voltage level of the third electrode is maintained at the data voltage, and the third electrode is floated during a period of time excluding the bias period of the first or third signal from a supply period of the first or third signal.

15. The plasma display apparatus of claim 14, wherein a floating voltage of the third electrode during a period of time when the second or fourth signal is supplied to the first electrode is substantially equal to a sum of the data voltage and a voltage supplied during a bias period of the second or fourth signal.

16. The plasma display apparatus of claim 12, wherein the first switch controls the supply of the data voltage to the third electrode during a first period shorter than the duration of the bias period of the first signal, or controls the supply of the data voltage to the third electrode during a period of time substantially equal to the duration of the bias period of the first signal.

17. The plasma display apparatus of claim 12, wherein the second switch controls the supply of the second reference voltage to the third electrode during a second period, which follows the bias period of the first signal, and causes the third electrode to be floated during a period of time excluding the bias period of the first signal from a supply period of the first signal.

18. A plasma display apparatus comprising:

a plasma display panel including a first electrode, a second electrode, and a third electrode;

a sustain driver that supplies a first sustain signal and a second sustain signal to the first electrode, and supplies a reference voltage to the second electrode during a sustain period of one subfield, the first sustain signal having a first maintaining period during which a voltage level of the first electrode is maintained at a positive sustain voltage and a second maintaining period during which a voltage level of the first electrode is maintained at a negative sustain voltage, and the second sustain signal having a third maintaining period during which a voltage level of the first electrode is maintained at the positive sustain voltage and a fourth maintaining period during which a voltage level of the first electrode is maintained at the negative sustain voltage; and a data driver that supplies a data signal to the third electrode during an address period, wherein a duration of the second maintaining period is equal to or longer than a duration of the first maintaining period, a duration of the third maintaining period is equal to or longer than a duration of the second maintaining period, a duration of the fourth maintaining period is equal to or longer than a duration of the third maintaining period, and a duration of at least one of the first to fourth maintaining periods is different from durations of the other maintaining periods.

19. The plasma display apparatus of claim 18, further comprising a reference separation controller that electrically separates or connects a first reference voltage source commonly connected to the sustain driver and the second electrode from or to a second reference voltage source connected to the data driver.

20. The plasma display apparatus of claim 18, wherein a sum of the durations of the first maintaining period and the third maintaining period is substantially equal to a sum of the durations of the second maintaining period and the fourth maintaining period.

* * * * *